United States Patent [19]

Uchiyama et al.

[11] Patent Number: 4,747,332

[45] Date of Patent: May 31, 1988

[54] ELECTRONIC MUSICAL INSTRUMENT FORMING TONES BY WAVE COMPUTATION

[75] Inventors: Yasuji Uchiyama, Hamamatsu; Hideo Suzuki, Kami, both of Japan

[73] Assignee: Nippon Gakki Seizo Kabushiki Kaisha, Hamamatsu, Japan

[21] Appl. No.: 842,933

[22] Filed: Mar. 24, 1986

Related U.S. Application Data

[63] Continuation of Ser. No. 718,186, Mar. 29, 1985, Pat. No. 4,616,546, which is a continuation of Ser. No. 434,230, Oct. 14, 1982, abandoned.

[30] Foreign Application Priority Data

Oct. 15, 1981 [JP] Japan ..... 56-164443

[51] Int. Cl.[4] ..... G10H 1/06

[52] U.S. Cl. ..... 84/1.23; 84/DIG. 2; 84/DIG. 20

[58] Field of Search ..... 84/1.19, 1.21, 1.22, 84/1.23, DIG. 2, DIG. 20

[56] References Cited

U.S. PATENT DOCUMENTS 4,218,948 8/1980 Nakada et al. ..... 84/1.01

4,416,180 11/1983 Ichigaya ..... 84/1.23

*Primary Examiner*—Forester W. Isen

*Attorney, Agent, or Firm*—Cushman, Darby & Cushman

[57] ABSTRACT

An electronic musical instrument is provided of the type in which a musical tone signal is formed by executing computations according to a mathematical formula such as a frequency modulation formula. Tone formation of each of musical tone signals to be simultaneously formed is assigned to each time-division-multiplexed time channel which is cyclically repeated over cycles of a plurality of time slots. A computation for forming each single musical tone is divided into a plurality of sub-computations, and those sub-computations are executed respectively using a plurality of cycles of time slots of each single time channel. Thus tone formation according to a complex computation formula is realized. Parameters necessary for the computation are generated respectively for each time slot so that any computational formula is adopted as desired by selecting predetermined parameters for each time slot.

6 Claims, 16 Drawing Sheets

READ ADDRESS

| ADDRESS | | 0 | 4 | 1 | 5 | 2 | 6 | 3 | 7 |
|---|---|---|---|---|---|---|---|---|---|
| TIMESLOT | POLYPHONIC MODE | a1-h1 (1st | a2-h2 Series) | | | i1-p1 (2nd | i2-p2 Series) | | |
| | MONOPHONIC MODE | a1 (1st | a2 Series) | b1 (2nd | b2 Series) | c1 (3rd | c2 Series) | d1 (4th | d2 Series) |
| STORAGE CONTENTS | | P2 | P2 | \| | \| | \| | \| | \| | P2 |
| | | P3 | P3 | \| | \| | \| | \| | \| | P3 |
| | | P4 | P4 | \| | \| | \| | \| | \| | P4 |
| | | P5 | P5 | \| | \| | \| | \| | \| | P5 |
| | | P6 | P6 | \| | \| | \| | \| | \| | P6 |
| | | P7 | P7 | \| | \| | \| | \| | \| | P7 |
| | | 32a | 32b | 32c | 32d | 32e | 32f | 32g | 32h |

32

FIG. 9
READ ADDRESS
| MODE SIGNAL | 0 | 4 | 1 | 5 | 2 | 6 | 3 | 7 |
|---|---|---|---|---|---|---|---|---|
| | a1-h1 | a2-h2 | | | i1-p1 | i2-p2 | | |
| | a1 | a2 | b1 | b2 | c1 | c2 | d1 | d2 |
| | I(t) | A(t) | I(t) | A(t) | I(t) | A(t) | I(t) | A(t) |
| 1 | IDP MP | \| \| | \| \| | \| \| | \| \| | \| \| | \| \| | IDP MP |
| 2 | IDP MP | \| \| | (L) | \| \| | \| \| | \| \| | \| \| | IDP MP |
| 4 | IDP MP | \| \| | \| \| | \| \| | \| \| | \| \| | \| \| | IDP MP |
| | 33a | 33b | 33c | 33d | 33e | 33f | 33g | 33h |
33
FIG. 10
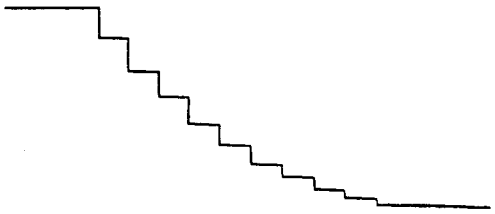
FIG. 11
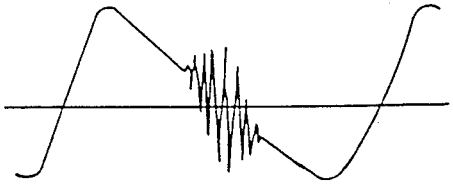

(a) TS
(b) CH
(c) ωmt/ωct
(d) A(t)'/I(t)'
(e) P6
(f) P7
(g) H
(h) LD
(i) CCR
ωmt (I)
ωct (I)
ωct (II)
ωmt (II)
I(t)'(I)
A(t)'(I)
A(t)'(II)
I(t)'(II)
1~5

(a) ωmt/ωct
(b) A(t)'/I(t)'
(c) P6
(d) P7
(e) H
(f) LD
(g) CCR
ωmt
ωct
I(t)'
A(t)'
1~5

(a) TS
(b) CH
(c) ωmt/ωct
(d) A(t)'/I(t)'
(e) P6
(f) P7
(g) H
(h) LD
(i) CCR
ωmt (I)
ωmt (II)
ωct (II)
I(t)'(I)
I(t)'(II)
A(t)'(I)
A(t)'(II)
1~5
16
0

(a) ωmt/ωct
(b) A(t)'/I(t)'
(c) P6
(d) P7
(e) H
(f) LD
(g) CCR
ωct
ωmt
I(t)'
A(t)'
I~5
16
0

(a) TS
(b) CH
(c) ωmt/ωct
(d) A(t)'/I(t)'
(e) P6
(f) P7
(g) H
(h) LD
(i) CCR (a) ωmt/ωct
(b) A(t)'/I(t)'
(c) P6
(d) P7
(e) H
(f) LD
(g) CCR

ELECTRONIC MUSICAL INSTRUMENT FORMING TONES BY WAVE COMPUTATION

This is a continuation of application Ser. No. 718,186, filed Mar. 29, 1985, now U.S. Pat. No. 4,616,546, which is a continuation of Ser. No. 434,230, filed Oct. 14, 1982, which is now abandoned.

BACKGROUND OF THE INVENTION

This invention relates to an electronic musical instrument of the type in which a musical tone signal is formed by executing computations according to a mathematical formula such as a frequency modulation formula.

Conventional electronic musical instruments using computations of a frequency modulation formula or the like for obtaining a musical tone signal have on one hand advantages and on the other hand disadvantages over known electronic musical instrument in which the tone coloring is determined such as by filters or by tone wave memory reading. One of the advantages is that a musical tone signal rich in tone colors can be generated in such conventional electronic musical instruments. However, the disadvantages also exist in that a rather complicated computation device with capabilities of high speed computational processing is required when a complicated computation for a musical tone signal is necessary or when a plurality of musical tone signals are formed simultaneously with one another.

SUMMARY OF THE INVENTION

It is therefore an object of the invention to provide a novel electronic musical instrument of the type in which a musical tone signal is formed by executing computations of mathematical formulas. It is another object of the invention to provide the novel electronic musical instrument as above in which a plurality of musical tone signals are capable of being formed with a relatively simple arrangement and low computational speed and in which various computational formulas can be employed in the computation of a musical tone signal.

To accomplish the above and other objects, briefly in the present invention, tone formation of each of musical tone signals to be formed is assigned to each time-division-multiplexed time channel which is cyclicaly (circulatingly) repeated over cycles of a plurality of time slots and wherein a computation for forming a single musical tone signal is divided into a plurality of sub-computations which are executed respectively using a plurality of cycles of time slots of each single time channel (a time period required for all the time slots for all time channels to circulate one round is herein referred to as one cycle period). Furthermore, parameters necessary for the computation are generated respectively for each time slot, thus any computational formula is adopted as desired for each time slot by selecting predetermined parameters.

According to one aspect of the invention, an electronic musical instrument comprises: time channel providing means for providing repeated cycles of a plurality of time slots, each correspondingly located time slot over the repeated cycles constituting each time-division-multiplexed time channel; tone formation assigning means for assigning to each time channel tone formation of each of musical tone signals to be formed; at least first and second signal computing means for computing in combination each musical tone signal per each time channel using at least two cycles of the time slots as a unit processing period, in which in the first cycle of at least two cycles the first signal computing means computes per each time channel a first wave signal for the assigned musical tone signal whereas in the second cycle of at least two cycles the second signal computing means computes per each time channel a second wave signal for the assigned musical tone signal using the result of the first wave signal; and musical tone wave forming means for forming a musical tone wave signal based on the result of the second wave signal.

The foregoing and other objects, the features and the advantages of the present invention will be pointed out in, or apparent from, the following description of the preferred embodiments considered together with the accompanying drawings.

BRIEF DESCRIPTION OF THE DRAWINGS

FIG. 9 is a diagrammatic representation of storage contents of the parameter register 33 shown in FIG. 5;

FIG. 10 is a schematic presentation of assistance in explaining the operation of the increment/decrement generator 43 shown in FIG. 5;

FIG. 11 is a schematic presentation of assistance in explaining the operation of the averaging circuit 57 shown in FIG. 3;

FIGS. 12 to 15 are used for explaining the operation of the musical tone forming circuit 2 employing a first frequency modulation formula, wherein FIG. 12 is a timing chart in a polyphonic mode, FIG. 13 is a timing chart in a monophonic mode, FIG. 14 shows a basic operational illustration, and FIG. 15 shows a more concrete operational illustration;

FIGS. 16 to 19 are used for explaining the operation of the musical tone forming circuit 2 employing a second frequency modulation formula, wherein FIG. 16 shows a basic operational illustration, FIG. 17 is a timing chart in a polyphonic mode, FIG. 18 is a timing chart in a monophonic mode, and FIG. 19 shows a more concrete operational illustration;

FIGS. 20 to 23 are used for explaining the operation of the musical tone forming circuit 2 employing a third frequency modulation formula, wherein FIG. 20 shows a basic operational illustration, FIG. 21 is a timing chart in a polyphonic mode, FIG. 22 is a timing chart in a monophonic mode, and FIG. 23 shows a more concrete operational illustration;

FIGS. 24 to 26 are used for explaining the operation of the musical tone forming circuit 2 employing a fourth frequency modulation formula, wherein FIG. 24 shows a basic operational illustration, FIG. 25 is a timing chart, and FIG. 26 shows a more concrete operational illustration.

DETAILED DESCRIPTION OF THE PREFERRED EMBODIMENTS

One embodiment of the invention will now be described with reference to the drawings. The terms "1" signal and "0" signal to be used in the following description are intended to represent signals respectively having binary logical values, "1" and "0".

Figure 1:
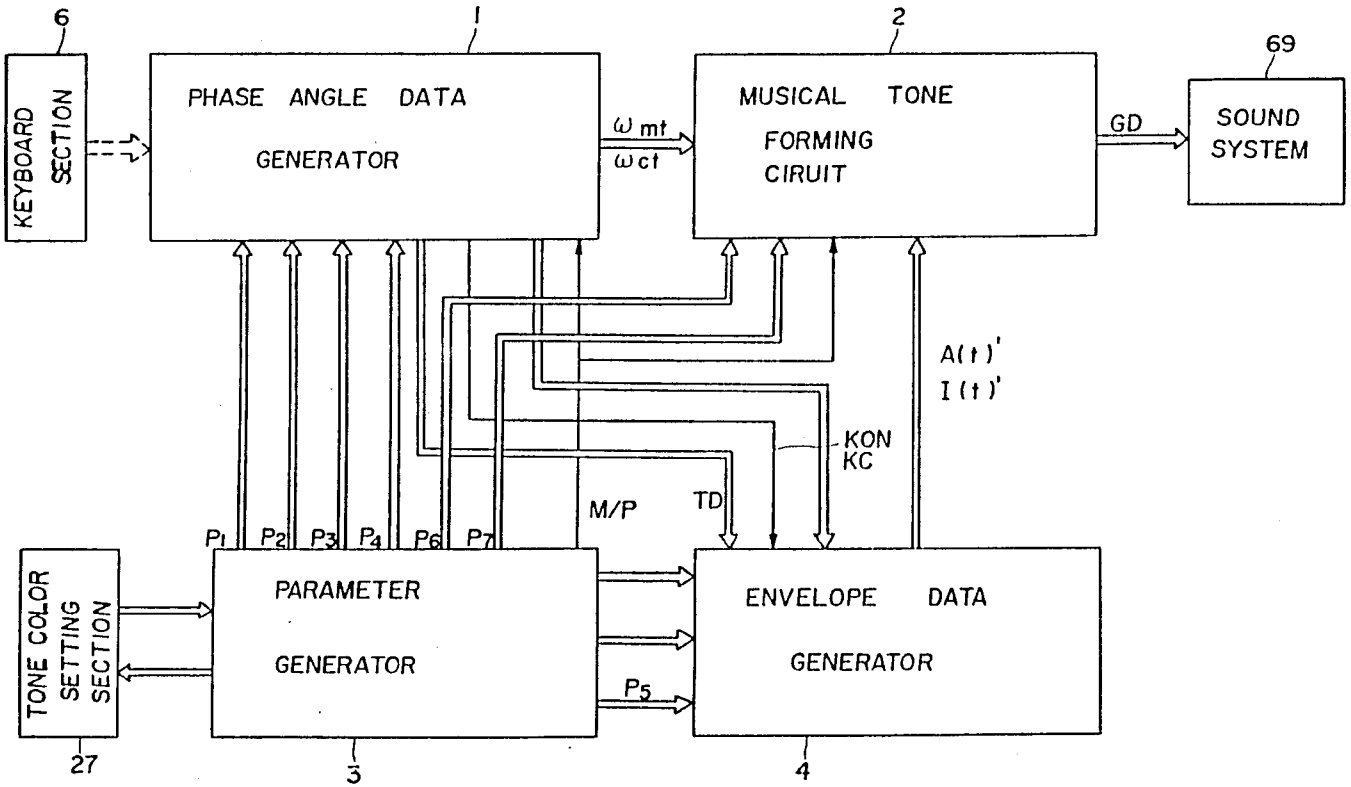
FIG. 1 is a block diagram showing a whole arrangement of an electronic organ according to one embodiment of the invention.

FIG. 1 is a block diagram showing the entire arrangement of an electronic organ (electronic musical instrument) of the present invention. FIGS. 2 to 5 are block diagrams showing respectively the detailed arrangement of the phase angle data generator 1, musical tone forming circuit 2, parameter generator 3, and envelope data generator 4 shown in FIG. 1. The outline of the electronic organ according to the embodiment of the invention is as follows.

(1) Musical tone signals are formed based on various frequency modulation equations including a typical frequency modulation equation given by:

$$Et(t)=A(t)\sin(\omega_c t+S\cdot I(t)\cdot\sin\omega_m t) \quad (1)$$

In the above equation (1), S represents a constant value, and a modulation factor is expressed as S·I(t) for the convenience of circuit fabrication.

(2) Monophonic And Polyphonic Modes Are Both Employed.

The term "monophonic mode" used herein is intended to represent such a mode that, if a plurality of keys are depressed simultaneously, only one musical tone is produced which has a highest (or lowest) pitch among the pitches corresponding to the depressed keys. The term "polyphonic mode" used herein is intended to represent such a mode that, if a plurality of keys are depressed simultaneously, a plurality of musical tones corresponding to the depressed keys are produced. In the present embodiment of the electronic organ, however, the number of musical tone generating channels is eight (8). As a result, in the case where keys more than eight in number are depressed in the polyphonic mode, musical tones corresponding to the depressed keys in excess of eight will not be produced.

(3) Musical Tone Signals Are Formed In A Time Division Multiplexed Manner.

Figure 6:
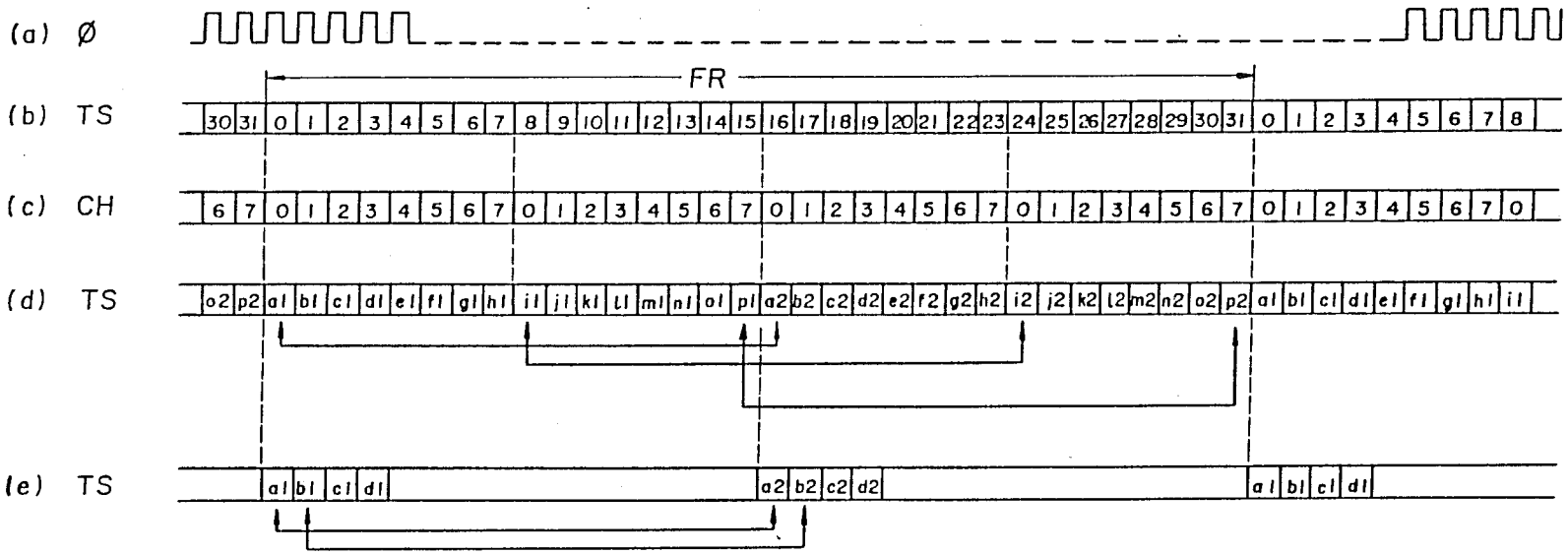
FIG. 6 (*a*) to (*e*) is a timing chart for illustrating a time slot TS, channel timing, and series of musical tone signals.

Specifically, as shown in (a) and (b) of FIG. 6, musical tone signals are formed by being processed independently in respective ones of the time slots TS(0) to (31). The time slots TS(0) to (31) are provided in response to a system clock pulse $\phi$ and are repeated cyclically (circulatingly) every thirty two clock pulses $\phi$. A time length comprised of thirty-two time slots TS(0) to (31), is referred to as a frame FR. In the polyphonic mode, as shown in (c) of FIG. 6, respective ones of the eight musical tone generating channels are time-divisionally repeated among thirty-two time slots TS(0) to (31). The time slots TS(0), (8), (16), and (24) are used for generation of a musical tone signal of channel No. 0, whereas the time slots (7), (15), (23), and (31), are used for a musical tone signal of channel No. 7. With respect to musical tone signals of channels Nos. 2 to 6, the corresponding time slots are used in the similar manner as above.

(4) Musical Tone Signal For Each Key Is Formed By Synthesizing Plural Series Of Musical Tone Signals.

In the polyphonic mode, a musical tone signal for a single key being depressed is formed by combining two series of musical tone signals, whereas in the monophonic mode a musical tone signal for a single key being depressed is formed by combining four series of musical tone signals. In this case, a musical tone signal of each series is formed by using the coresponding two time slots in the different cycles of the time slot repetition.

More in detail, as shown in (d) of FIG. 6, in the polyphonic mode, a musical tone signal of a first series for channel-0 is formed in the time slots TS(a1) and (a2), that is, the time slots TS(0) and (16), whereas a musical tone signal of a second series for channel-0 is formed in the time slots TS(i1) and (i2), that is, the time slots TS(8) and (24). Similarly as above, for channel-1 to channel-7, musical tone signals of the first series are formed in the respective time slots TS(b1) and (b2) to TS(h1) and (h2), while musical tone signals of the second series are formed in the respective time slots TS(j1) and (j2) to TS(p1) and (p2).

On the other hand, in the monophonic mode, as shown in (e) of FIG. 6, a musical tone signal of a first series is formed in the time slots TS(a1) and (a2), that is, the time slots TS(0) and (16), a musical tone signal of a second series is formed in the time slots TS(b1) and (b2), a musical tone signal of a third series is formed in the time slots TS(c1) and (c2), and a musical tone signal of a fourth series is formed in the time slots TS(d1) and (d2).

Depending upon the selected mode, the parameter generator 3 outputs either a "0" M/P signal or "1" M/P signal respectively for the polyphonic or monophonic mode.

The above description gives an outline of the electronic organ according to the embodiment of the present invention. Hereinafter, a detailed description of each circuit constituting the electronic organ will be given one after another.

(1) Phase Angle Data Generator 1

Figure 2:
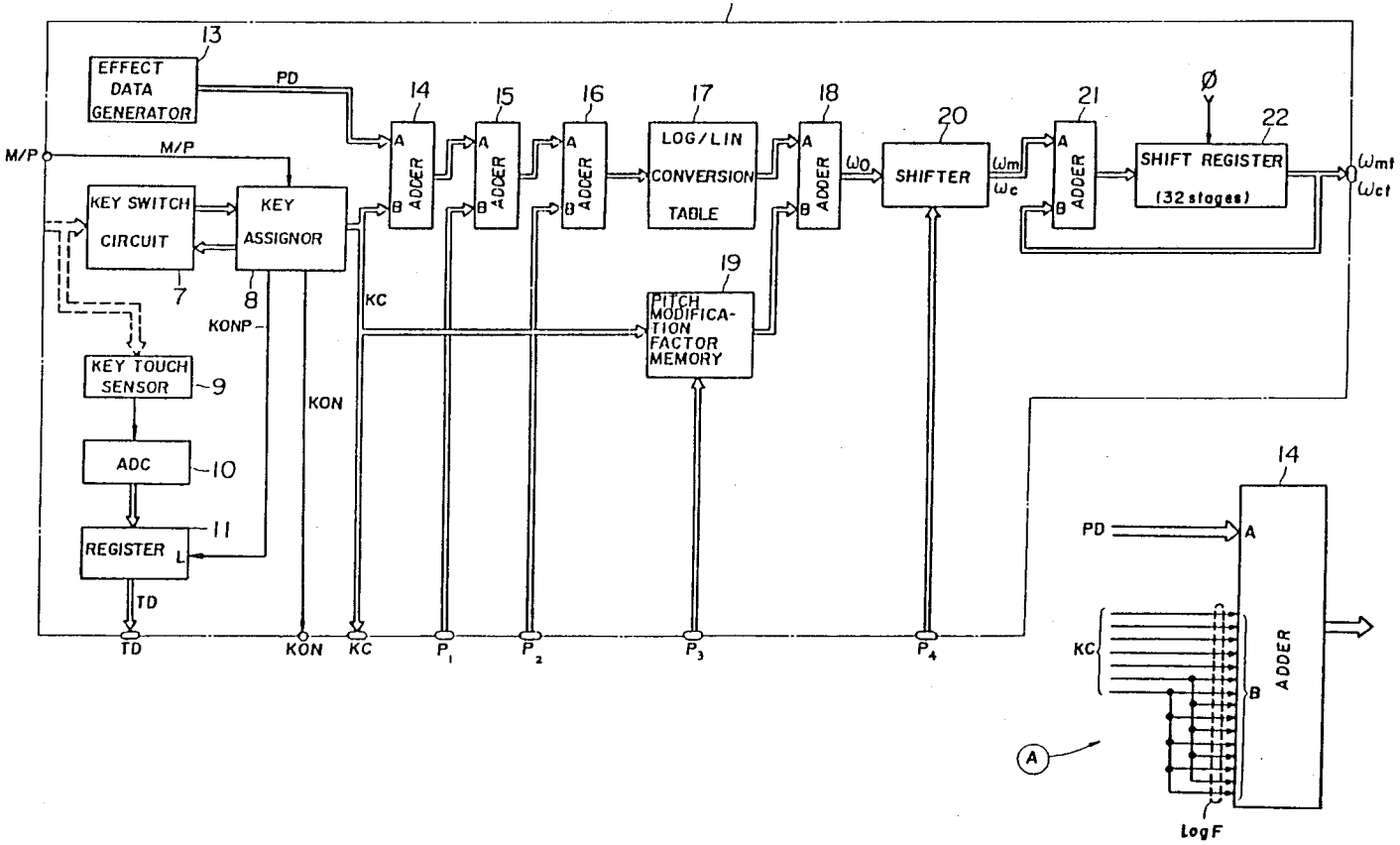
FIGS. 2 to 5 are block diagrams showing respectively the detailed arrangement of the phase angle data generator 1, musical tone forming circuit 2, parameter generator 3, and envelope data generator 4 of the electronic organ shown in FIG. 1.

Referring now to FIG. 2, there is provided a key switch circuit 7 which comprises a plurality of key switches, each corresponding to each key of the keyboard section 6 (FIG. 1) and the number of key switches is the same as that of the keys. A key assignor 8 operates in a different way depending upon whether the M/P signal supplied from the parameter generator 3 is "1" signal or "0" signal.

(a) M/P signal="0" (Polyphonic Mode)

In the case where the M/P signal "0" is supplied from the parameter generator 3, the key assignor 8 sequentially scans the outputs of the respective key switches of the key switch circuit 7 to detect the keys now being depressed. Thereafter, the key assignor 8 assigns key codes KC representative of the pitches of the respective detected keys to available ones of eight channels (channel-0 to channel-7), and outputs the assigned key codes KC for the respective channels at the time slots TS (FIG. 6 (*b*)) corresponding to the respective assigned channels. In addition, at the same timing, the key assignor 8 outputs a key-on signal KON indicative of the depression or release of the key corresponding to the key code KC assigned to a particular channel. The key-on signal KON keeps assuming a "1" signal while the key is being depressed, whereas the key-on signal KON keeps a "0" signal while the key is being released. The key code KC is a seven-bit code composed of a three-bit octave code representing the octave identification of the depressed key and a four-bit note code identifying the note name (within an octave) of the depressed key.

(b) M/P signal="1" (Monophonic Mode)

In the case where the M/P signal "1" is supplied from the parameter generator 3, the key assignor 8 sequentially scans the outputs of the respective key switches of the key switch circuit 7 to detect the keys now being depressed. Thereafter, the key assignor 8 selects the key corresponding to the highest pitch among the depressed keys to output continuously the key code KC representing the highest pitch. In addition, the key assignor 8 keeps on continuously outputting the key-on signal KON ("1" signal) after and as long as the key corresponding to the highest pitch is depressed, and turns the key-on signal KON to a "0" signal upon release of the same key.

In both cases (a) and (b), the key assignor 8 also outputs a key-on pulse KONP of a short width at the leading (build-up) edge of the key-on signal KON.

A key touch sensor 9 is provided in order to detect key touch information such as speed, pressure, or depth of the depressed key in the keyboard 6. The analog output from the key touch sensor 9 is converted into a digital data by an analog/digital convertor 10 (hereinafter referred to as ADC) and then is supplied to register 11. In this embodiment, a single key touch sensor 9 is provided in common to all the keys of the keyboard section 6, however, the key touch sensor 9 may be provided independently for every group (note range) of keys or for each single key. The detection of key touch information for each single key may alternatively be carried out by discriminating the key depression speed from the output of the key switch, without using the key touch sensor 9. In this case, two key switches are required for each key which are different in operational timings with respect to the movement of the depressed key. When the key-on pulse KONP is supplied at a load terminal of the register 11, the register 11 receives the output from the ADC 10, and outputs it as a touch data TD. Therefore, every time a new key is depressed in the keyboard section 6, the register 11 outputs key touch information regarding the key touch of the depressed key. An effect data generator 13 generates an effect data PD in logarithmic format which imparts to a musical tone signal a pitch modulation effect such as a vibrato effect, or a glide effect. The output PD from the effect data generator 13 is supplied to an A input terminal of an adder 14.

The adder 14 is a 15-bit adder, and as shown by a symbol Ⓐ at the bottom right in FIG. 2, a B input terminal of the adder 14 receives at its upper seven bits the key code KC, and receives at its lower eight bits the least two bits of the key code KC in a sequentially repeated manner. As a result, a data logF can be inputted to the B input terminal of the adder 14, the data logF being in logarithmic form of a number (which is referred to as a frequency number F) proportionate to a musical tone frequency corresponding to a key code KC of a key concerned. The reason why the data logF can be attained in such a way is disclosed in detail in U.S. Pat. No. 4,351,212 assigned to the same assignee of this invention and incorporated herein by reference thereto. The description thereof, however, is omitted in view of the nature that it is beyond the gist of the invention. The adder 14 adds the effect data PD and the data logF, the added result being supplied to an A input terminal of an adder 15. A B input terminal of the adder 15 is supplied from the parameter generator 3 (FIG. 1) with a parameter signal P1 which functions to change a pitch of a musical tone signal in octave unit. In the case that there is no need for changing the pitch of a musical tone signal in octave unit, the parameter signal P1 equals 0. However, when musical tones of such as a piccolo are to be produced which necessiates the alteration of pitches in octave unit (shifting up by one), a suitable parameter signal P1 is prepared in accordance with the amount of the octave alteration required. The parameter signal P1 is a data represented in logarithmic format. The adder 15 adds the parameter P1 to the output from the adder 14, and the added result is supplied to an A input terminal of an adder 16. A B input terminal of the adder 16 is supplied with a parameter P2 which functions to slightly change a pitch between musical tone signals of the previously described each series of musical tone signals (two series for the polyphonic mode, and four series for the monophonic mode). More in particular, it is known in the art that a musical tone, for example, in a medium pitch range of a piano is produced by striking with a hammer three strings for each key. In this case, the pitch of each of the three strings is not the same but is slightly different from one another. Thus, the parameter signal P2 aims at making a musical tone to be produced more similar to a natural tone, by giving a slight difference in pitch to each musical tone signal between each series. The parameter signal P2 is also a data represented in logarithmic format. The adder 16 adds the parameter P2 to the output from the adder 15, and the added result is supplied to a log/lin conversion table 17 as an address signal. The log/lin conversion table 17 is a read only memory (ROM) in which the logarithmic format data from the adder 16 is converted into a linear format data. Upon reception of the address signal from the adder 16, the linear format data stored in the location identified by the address signal is read out and then is supplied to an A input terminal of an adder 18. A B input terminal of the adder 18 is supplied with the output from a pitch modification factor memory 19.

The pitch modification factor memory 19 together with the adder 18 is provided in order to impart to a musical tone corresponding to each key a pitch deviation. That is, in tuning a piano, pitches of higher tones are modified to slightly deviate to higher ones from theoretical ones while pitches of lower tones are modified to lower ones. Thus, practically none of the musical tones are set at its theoretical musical tone frequency. Illustratively in the embodiment, the pitch modification factor memory 19 is a ROM in which pitch modification factor data corresponding to each key are stored respectively for each tone color.

After identifying the tone color with the parameter signal P3 and the key with the key code KC, the pitch modification factor data corresponding to the tone color and key is read out of the pitch modification factor memory 19 and is supplied to the B input terminal of the adder 18. Alternatively, the pitch modification factor data may be used as one single data assigned to a group of keys such as three or six consecutive keys. The adder 18 adds the outputs from the log/lin conversion table 17 and pitch modification factor memory 19 to thereby deliver the added result to a shifter 20 as a data $\omega_o$. The shifter 20 shifts the data $\omega_o$ (binary number data) toward the upper or lower bit direction by the number of bits designated by a parameter signal P4, so that a data $W_m$ or $W_c$ (refer to the equation (1) above) is formed to be supplied to an A input terminal of an adder 21. It is understood that the shift of the binary number data $W_o$ by one, two, three bits . . . toward the upper bit means the multification of the binary number data $W_o$ by two, four, eight times . . .

The adder 21 and a shift register 22 of thirty-two stages in combination perform the same function as thirty-two accumulators. The output from the adder 21 is supplied to an input terminal of the thirty-two stage shift register 22, which is driven by a clock pulse $\phi$, and the output from the shift register 22 is returned to the B input terminal of the adder 21.

In the phase angle data generator 1 thus constructed, the output data ($\omega_m$ or $\omega_c$) from the shifter 20 is accumulated independently at each of the time slots TS(0) through (31) shown in FIG. 6. That is, at the time slot TS(0), appearing at the output of the shift register 22 is the data which has been supplied from the adder 21 at the previous time slot TS(0) or at the thirty-two time slots (one frame) before the present one. This previous output data from the shift register 22 is then added to a new output data from the shifter 20 in the adder 21. The new added data is supplied to the shift register 22, and after being delayed by thirty-two time slots, that is at the next time slot TS(0), is then added to the output data from the shifter 20 in the adder 21. Similar operations are followed every time the time slot TS(0) appears, thereby performing an accumulation. Apart from the time slot TS(0), the other time slots TS(1) through (31) are also subjected to the same operation as above to effect an accumulation of the output data from the shifter 20. Thus, the accumulated value of the output data ($\omega_m$ or $\omega_c$) from the shifter 20 for each of the time slots TS(0) through (31) is outputted to the musical tone forming circuit 2 as a phase angle data $\omega_m t$ or $\omega_c t$ (refer to the equation (1) above).

When the accumulated value overflows in the shift register 22, the accumulation starts again from the residual value stored in the shift register 22. In other words, the change of the accumulated value (phase angle data $\omega_m t$ or $\omega_c t$) may be represented as a shape of a sawtooth wave whose repetition frequency is proportionate to the output data from the shifter 20.

It is to be noted here that the phase angle data $\omega_m t$ is outputted from the shift register 22 at the time slots TS(0) through (15), while the phase angle $\omega_c t$ is at the time slots TS(16) through (31), as described later.

(2) Parameter Generator 3

Figure 4:
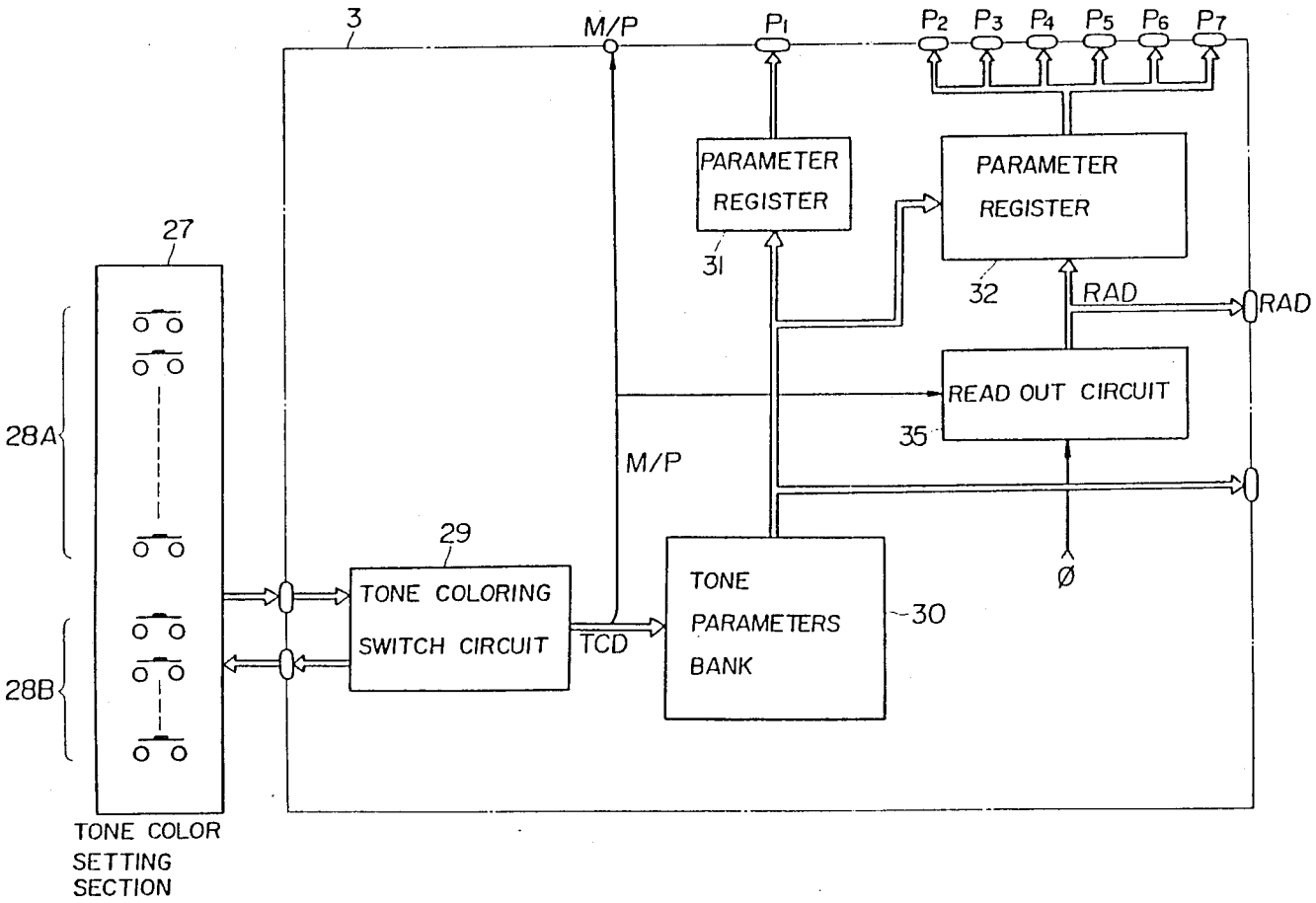

Referring now to FIG. 4, there is provided a tone color setting section 27 for setting tone colors of the musical tone signals, which comprises a plurality of tone switches 28A and 28B respectively for use in the polyphonic and monophonic modes. The tone switches 28A and 28B are arranged such that particular tone colors in the polyphonic mode can be designated by the actuation of the tone switches 28A, whereas the tone switches 28B are used in the monophonic mode.

A tone color switch circuit 29 scans sequentially the outputs of the tone switches of the tone color setting section 27 to detect the tone switches now being actuated, and selects one of the tone switches at the highest priority order according to the predetermined priority order so as to output a tone code TCD corresponding to the selected tone switch. The contents of the tone code TCD is formed in such an arrangement that the most significant bit (MSB) is "0" when the tone switch 28A for the polyphonic mode is actuated, while on the other hand the most significant bit is "1" when the tone switch 28B for the monophonic mode is actuated. Accordingly, the most significant bit of the tone code TCD are used as the signal M/P for identifying the monophonic/polyphonic mode. A tone parameters bank 30 stores various parameters necessary for forming musical tone signals in correspondence with the respective tone colors settable at the tone color setting section 27. Upon reception of the tone code TCD as an address signal of the tone parameters bank 30, the parameters corresponding to the addressed tone code TCD are read out and are supplied to parameter registeres 31 ahd 32 shown in FIG. 4 and a parameter register 33 shown in FIG. 5. The parameter register 31 is supplied with a parameter signal which remains constant irrespective of the time slots TS(0) through (31), that is, such a parameter as the parameter signal P1 described above. The parameter register 32 is supplied with the aforementioned parameter signals P2 through P4 and also with parameter signals P5 through P7 described later. The parameter register 33 is supplied with parameters necessary for forming an amplitude data A(t) and a modulation factor data I(t) (refer to the equation (1)). These parameters are supplied to the respective parameter registers 31 through 33 for being stored therein.

Figures 7, 8:
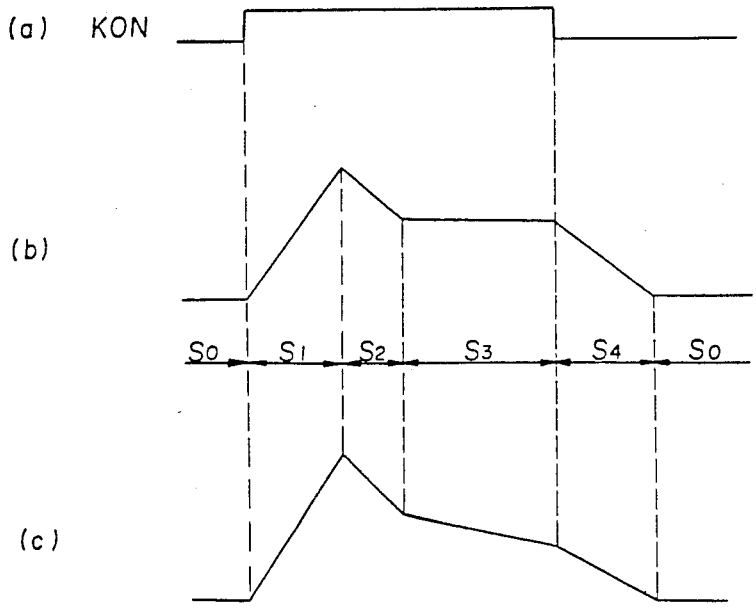
FIG. 7 is a diagrammatic representation of storage contents of the parameter register 32 shown in FIG. 4.
FIG. 8 (*a*) shows a key-on signal KON, FIG. 8 (*b*) to (*c*) shows in a time domain wave forms of an amplitude data $A(t)_1$ or a modulating factor data $I(t)_1$.

As diagrammatically shown in FIG. 7, the parameter register 32 comprises eight registers **32*a* through 32*h*. The register 32*a* stores the parameter signals P2 through P7 which are utilized either at the time slots TS(a1) through (h1) as particularly shown in FIG. 6** (*d*), that is, the time slots TS(0) through (7), in the polyphonic mode, or at the time slots TS(a1) as particularly shown in FIG. 6 (*e*) in the monophonic mode. Similarly to the above, the other registers **32*b* through 32*h* also store the parameter signals P2 through P7 which are used at the corresponding time slots TS as depicted in FIG. 7. As is apparent from FIG. 7, the registers 32*c*, 32*d*, 32*g*, and 32*h* are not used in the polyphonic mode. The addresses (0) through (7) are assigned, as shown at the top line of FIG. 7, to the registers 32*a* through 32*h* so that, when these reading address signals RAD are supplied from a read-out circuit 35, the parameter signals P2 through P7 corresponding to the reading address signal RAD are read out of the respective registers 32*a* through 32*h*** to deliver them to the associated circuits.

The read-out circuit 35 comprises a thirty-two stage counter which counts up the clock pulse $\phi$ and a converter in which the output of the counter is encoded and is outputted therefrom as the reading address signal RAD. The converter converts the count outputs (0) through (31) from the counter into the encoded read address signal RAD as shown in Table 1, depending upon the value "1" or "0" of the signal M/P. It is to be noted that the symbol X in Table 1 indicates that no code is used for the circuit operation.

TABLE 1

| COUNT OUTPUT | M/P "1" | M/P "0" | COUNT OUTPUT | M/P "1" | M/P "0" |
|---|---|---|---|---|---|
| 0 | 0 | 0 | 16 | 4 | 4 |
| 1 | 1 | 0 | 17 | 5 | 4 |
| 2 | 2 | 0 | 18 | 6 | 4 |
| 3 | 3 | 0 | 19 | 7 | 4 |
| 4 | | 0 | 20 | | 4 |
| 5 | X | 0 | 21 | X | 4 |
| 6 | | 0 | 22 | | 4 |
| 7 | | 0 | 23 | | 4 |

TABLE 1-continued

| COUNT OUTPUT | M/P "1" | M/P "0" | COUNT OUTPUT | M/P "1" | M/P "0" |
|---|---|---|---|---|---|
| 8 | | 2 | 24 | | 6 |
| 9 | X | 2 | 25 | X | 6 |
| 10 | | 2 | 26 | | 6 |
| 11 | | 2 | 27 | | 6 |
| 12 | | 2 | 28 | | 6 |
| 13 | X | 2 | 29 | X | 6 |
| 14 | | 2 | 30 | | 6 |
| 15 | | 2 | 31 | | 6 |

The count outputs shown in Table 1 correspond to the respective time slots TS(0) through (31). That is, in the monophonic mode (signal M/P="1"), the read-out circuit 35 outputs the reading address signals RAD (0) through (3) at the respective time slots TS(0) through (3), and also outputs the reading address signals RAD (4) through (7) at the respective time slots TS(16) through (19). In the polyphonic mode (signal M/P="0"), the read-out circuit 35 outputs the reading address signal RAD (0) at the respective time slots Ts(0) through (7), and also outputs the reading address signals RAD (2), (4), and (6) at the respective time slots TS(8) through (15), (16) through (23), and (24) through (31).

As a result, for example, at the time slot TS(2) in the monophonic mode, the reading address signal RAD (2) is transferred to the parameter register 32 so that the parameters P2 through P7 are read out of the register 32*e* shown in FIG. 7. The reading address signal RAD is also transferred to the parameter register 33 for reading-out the contents thereof.

(3) Envelope Data Generator 4

Figure 5:
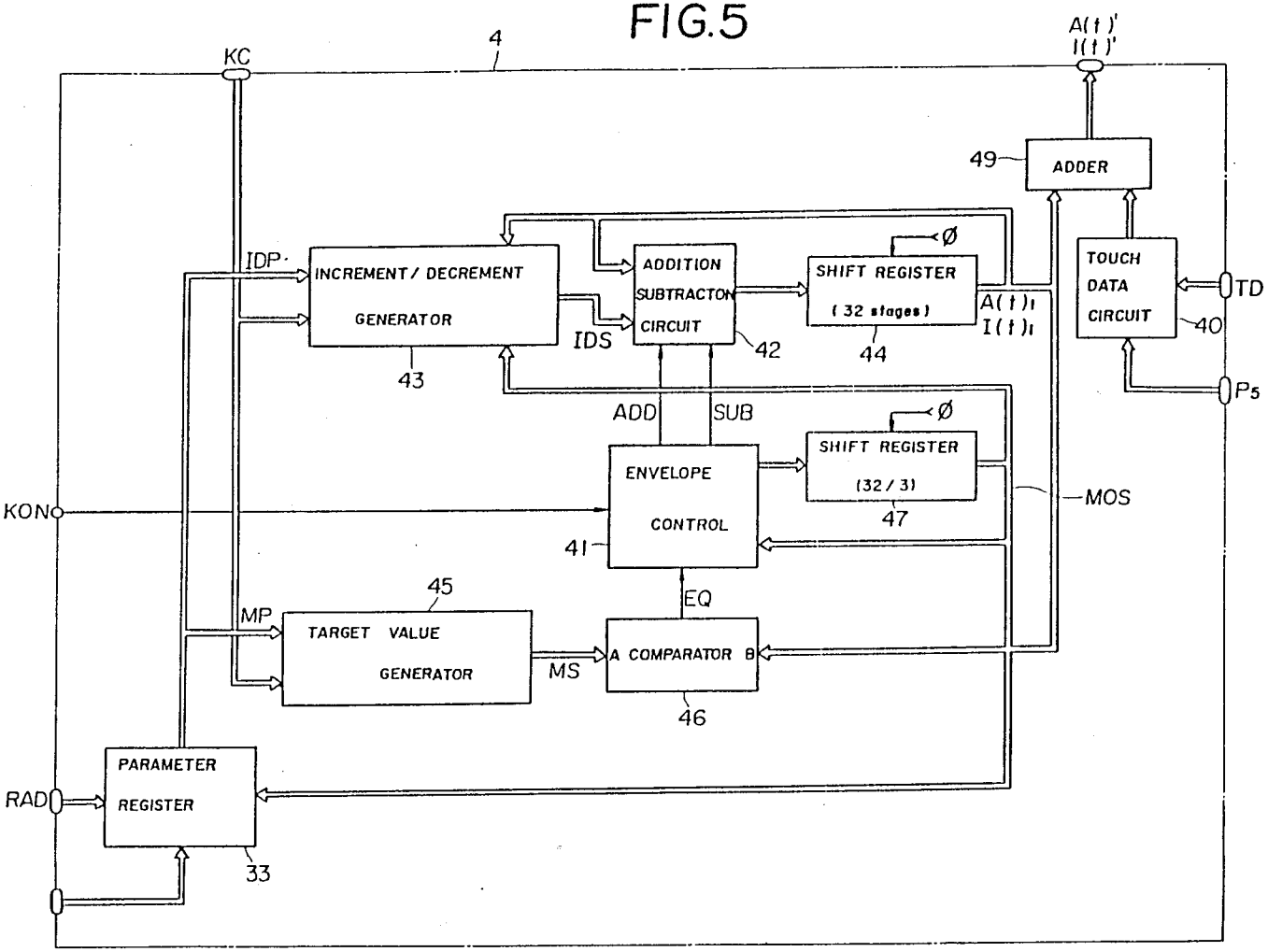

Referring now to FIG. 5, in response to a key-on signal KON illustratively shown in FIG. 8 (*a*), the envelope data generator 4 generates an amplitude data A(t)1 or a modulation factor data I(t)1 whose value changes such as shown in FIG. 8 (*b*), and adds the output from a touch data circuit 40 to one of the above data A(t)1 and I(t)1 in order to supply the added result to the musical tone forming circuit 2 as an amplitude data A(t)' or a modulation factor data I(t)'.

First, the operation of the envelope data generator 4 will be described briefly. Upon reception of the key-on signal KON "1" from the phase angle data generator 1 (that is, a key is depressed), an envelope control circuit 41 delivers a signal ADD to an addition and subtraction circuit 42 which thereafter adds an increment/decrement value IDS outputted from an increment/decrement generator 43 to the contents of a shift register 44 every thirty-two clock pulses $\phi$, thereby accumulating the contents of the shift register 44. The shift register 44 is a thirty-two stage shift register driven by the clock pulse $\phi$, and has been reset at its initial condition. The contents of the shift register 44 increases accordingly, and is outputted as the amplitude data A(t)1 or the modulation factor data I(t)1 as described above. The increase of the contents of the shift register 44 is depicted as a mode S1 in FIG. 8 (*b*).

The contents of the shift register 44 continues to increase until it reaches a target value MS given from a target value generator 45. At this time instant, a comparator 46 delivers an equal signal EQ to the envelope control circuit 41 which this time outputs a signal SUB instead of the signal ADD. With the signal SUB being supplied to the addition and subtraction circuit 42, the circuit 42 subtracts an increment/decrement value IDS from the contents of the shift register 44 every thirty-two clock pulses $\phi$, thereby decreasing the contents of the shift register 44. The decrease of the contents of the shift register 44 is depicted as a mode S2 in FIG. 8 (*b*). The contents of the shift register 44 continues to decrease until it reaches another target value MS from the target value generator 45. When a coincidence occurs between the contents of the shift register 44 and the target value MS, the comparator 46 delivers again the equal signal EQ to the envelope control circuit 41 which this time outputs again the signal SUB. In this time, however, since the increment/decrement generator 43 outputs a "0" signal, the contents of the shift register 44 is held unchanged. This unchanged state is depicted as a mode S3 in FIG. 8 (*b*). Next, when the key-on signal KON is turned to "0" (that is, the depressed key is released), the envelope control circuit 41 delivers again the signal SUB and the increment/decrement generator 43 delivers a new increment/decrement value IDS (this time not "0"). As a result, the new increment/decrement value IDS is subtracted from the contents of the shift register 44 every thirty-two clock pulses $\phi$, thereby decreasing the contents of the shift register 44. This state is depicted as a mode S4 in FIG. 8 (*b*). When the contents of the shift register 44 reaches the target value MS (in this state, MS=0) outputted from the target value generator 45, the comparator 46 delivers the equal signal EQ to the envelope control circuit 41 which causes this time the signals ADD and SUB to be inhibited. This results in the "0" output of the addition and subtraction circuit 42, and the termination of operation of the envelope data generator 4 for one key-on signal KON.

The above description has been given for briefly explaining the operation of the envelope data generator 4. It is to be noted here that the operation described above is for each one time slot TS (one of the time slots TS(0) through (31)) which appears cyclically every thirty-two clock pulses $\phi$. That is, in the envelope data generator 4, the above operation is carried out independently at each of the time slots TS(0) through (31). Therefore, it is also appreciated that the increment/decrement value IDS, target value MS, signals ADD and SUB are provided independently for each one of the time slots TS(0) through (31), disregarding whether those values for each one of the time slots are identical to or different from each other.

Now, a detailed description will be given with respect to the above envelope data generator 4.

As diagrammatically shown in FIG. 9, the parameter register 33 is made up of 8×3 registers each of which stores an increment/decrement value parameter IDP and a target value parameter MP both being supplied from the tone parameters bank 30. These parameters IDP and MP are used for generating respectively the increment/decrement and target values IDS and MS described already. A column of registers 33*a* including three registers stores the parameters IDP and MP for use at the time slots TS(a1) through (h1) shown in FIG. 6 (*d*) (in the polyphonic mode), and for use at the time slot (a1) (in the monophonic mode). The parameters IDP and MP stored in a column of registers 33*a* are used in forming the modulation factor data I(t)1. Similarly, the parameters IDP and MP stored in each column of registers 33*b* through 33*h* are used in forming the modulation factor data I(t)1 or amplitude data A(t)1 at the time period of each corresponding time slot or slots as shown in FIG. 9. Each of the columns of registers 33*a* through 33*h* is respectively identified by the corresponding reading address signals RAD (0) through (7), and the three registers constituting each of the columns of registers 33*a* through 33*h* are respectively identified by corresponding mode signals MOS (1), (2), and (4) supplied from the shift register 47. For example, when the reading address signal RAD "1" together with the mode signal MOS "2" is supplied to the parameter register 33, then the parameters IDP and MP stored in the location designated by Ⓛ in the figure are read out thereof, and are supplied respectively to the increment/decrement generator 43 and target value generator 45. Each of the mode signals MOS (0) through (4) corresponds respectively to each of the modes S0 through S4. Thus, as is apparent from FIG. 9, in the case when either one of the modes S0 and S3 is selected, addressing any one of the three registers is not performed so that the parameters IDP and MP are not read out of the parameter register 33 (or "0" outputs are delivered from the parameter register 33).

The increment/decrement generator 43 converts the increment/decrement value parameter IDP into the increment/decrement value IDS to be outputted therefrom in accordance with the key code KC, the output of the shift register 44 (the amplitude data A(t)1 or modulation factor data I(t)1), and the mode signal MOS. The conversion into the increment/decrement value IDS is explained more concretely: for the keys corresponding to lower pitches (in the case of smaller key code KC), smaller increment/decrement values IDS are given, whereas for the keys corresponding to higher pitches (in the case of higher key code KC), larger increment/decrement values IDS are given. The resultant effect is that the slopes of the data A(t)1 or I(t)1 in the modes S1, S2, and S4 can be made gentle for the keys corresponding to lower pitches, and steep for the keys corresponding to higher pitches. Furthermore, in the case that the mode signal MOS(2) or (4) is being supplied (in the mode S2 or S4), larger increment/decrement values are given for larger outputs of the shift register 44, whereas smaller increment/decrement values are given for smaller outputs of the shift register 44. The resultant effect for this is that the slopes of the data A(t)1 or I(t)1 in the modes S2 and S4 can be changed exponentially as shown in FIG. 10. When the increment/decrement value parameter IDP is "0" (that is, in the mode S0 or S3), the increment/decrement value IDS is set at "0". It is to be noted that the above conversion of the parameter IDP into the value IDS is performed for the purpose of obtaining a musical tone more natural in tone color.

The target value generator 45 converts the target value parameter MP into the target value MS to be outputted in accordance with the key code KC. Thus, the waveform shown in FIG. 8 (*b*) can be changed in accordance with the key code KC (that is, in accordance with the pitch corresponding to the depressed key). It can be understood from the above description that in the increment/decrement generator 43 the conversion of the increment/decrement value parameter IDP is aimed at changing the slopes in the modes S1, S2, and S4 in accordance with the key code KC, while in the target value generator 45 the conversion of the target value parameter MP is aimed at changing the values of intersecting point between the modes S1 and S2 and the modes S2 and S3.

The shift register 47 is a thirty-two stage shift register which stores the aforementioned mode signal MOS in corresponding relation to each of the time slots TS(0) through (31). For example, delivery of the mode signal MOS (2) from the shift register 47 means that the data A(t)1 or I(t)1 generated at a certain time slot TS during which the mode signal MOS (2) is being delivered should be assigned to the data to be used in the mode S2.

The envelope control circuit 41 causes the shift register 47 to store the mode signal MOS (1) when the key-on signal KON rises to "1". Thereafter, the shift register 47 sequentially stores the mode signals MOS (2), (3), (4), and (0) in this order respectively when the equal signal EQ is outputted from the comparator 46, when again the equal signal EQ is outputted from the comparator 46, when the key-on signal KON falls to "0", and when further again the equal signal EQ is outputted from the comparator 46. When the mode signal MOS (0) is outputted from the shift register 47, the envelope control circuit 41 outputs neither of the signals ADD and SUB, when the mcde signal MOS(1) is outputted, then the signal ADD is outputted from the envelope control circuit 41, and finally when the mode signals MOS(2) through (4) are outputted, the signal SUB is outputted from the envelope control circuit 41. As described previously, the operation of the envelope control circuit 41 is performed independently for each of the time slots TS(0) through (31).

The touch data circuit 40 converts the touch data TD supplied from the phase angle data generator 1 (FIG. 2) in accordance with the parameter signal P5 supplied from the parameter register 32, the converted data being applied to an adder 49. The above conversion is performed in order to vary the musical effects of a musical tone signal given by the touch data TD in accordance with each tone color concerned. The adder 49 adds the output from the touch data circuit 40 to the amplitude data A(t)1 or modulation factor data I(t)1 from the shift register 44, and then output the amplitude data A(t)' or modulation factor data I(t)' to be supplied to the musical tone forming circuit 2.

In the envelope data generator 4, it may be possible to produce different amplitude modulation data A(t)1 or modulation factor data I(t)1 of another alternative envelope waveform (percussion type envelope waveform) such as shown in FIG. 8 (*c*). This can be accomplished by generating a predetermined (not (0)) increment/decrement value IDS in the increment/decrement generator 43 in the mode S3 and by adding one more register for use in the mode S3 to each column of registers 33*a* through 33*h* (FIG. 9) of the parameter register 33.

(4) Musical Tone Forming Circuit 2

Figure 3:
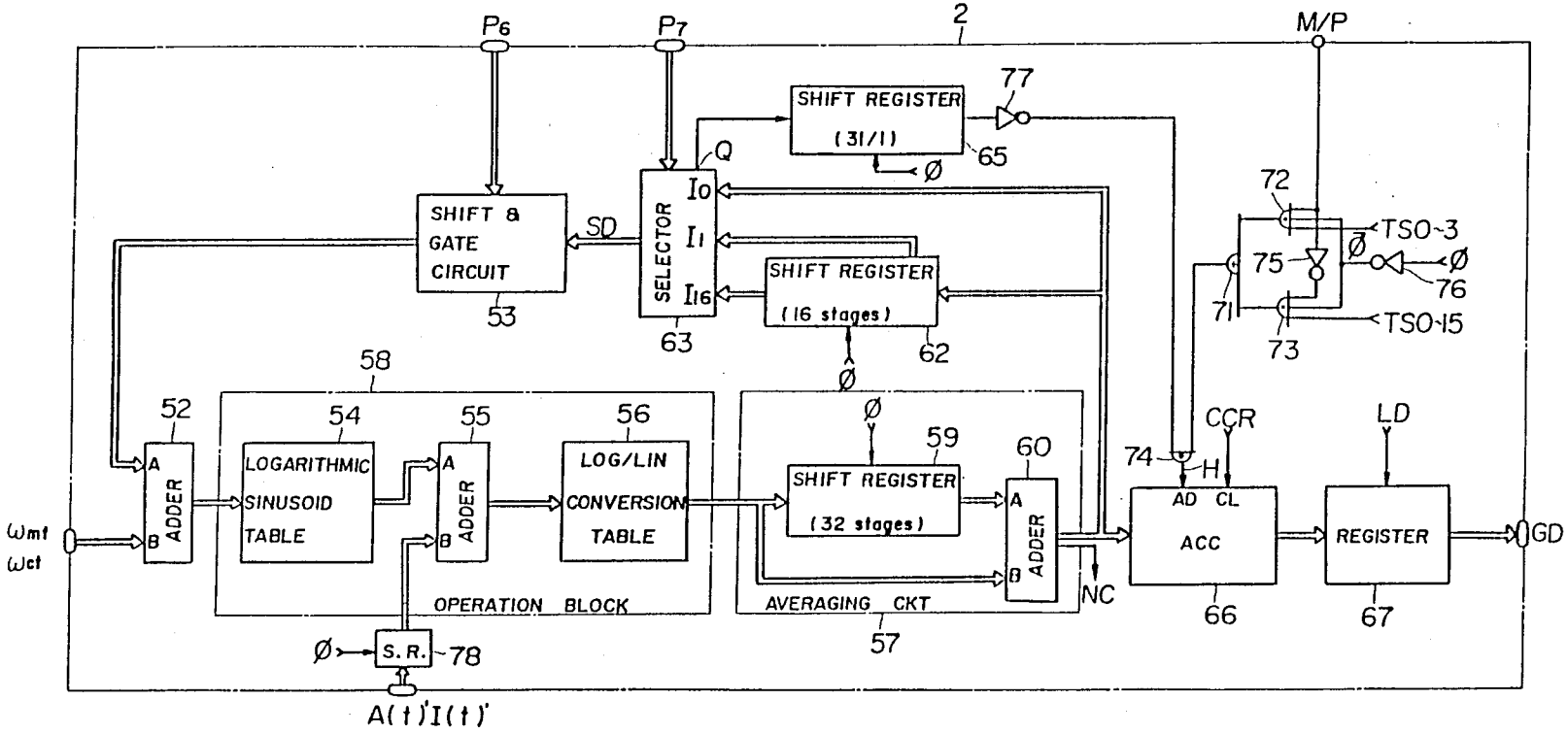

The musical tone forming circuit 2 particulary shown in FIG. 3 is a circuit provided for forming a musical tone wave signal GD such as written in a form of the above equation (1), in accordance with the aforementioned phase angle data $\omega_m t$ and $\omega_c t$ from the phase angle data generator 1, and the amplitude data A(t)' and modulation factor data I(t)' from the envelope data generator 4. It is appreciated that other types of musical tone wave signals represented by other various frequency modulation formulas can be formed by the musical tone forming circuit 2, without confining applications only to the above equation (1).

Each circuit element of the musical tone forming circuit 2 will be described hereinunder. An adder 52 adds the output of a shift and gate circuit 53 and the phase angle data $\omega_m t$ or $\omega_c t$. The added result is supplied as an address signal to a logarithmic sinusoid table 54 which is a ROM storing in logarithmic format instantaneous values sampled from a sinusoidal waveform. After being addressed by the output from the adder 52, the logarithmic sinusoid table 54 transfers the addressed instantaneous value to an adder 55. The adder 55 adds the output from the logarithmic sinusoid table 54 and the amplitude data A(t)′ or modulation factor data I(t)′ from a shift register 78 to thereby deliver the added result to a log/lin conversion table 56 which is a ROM provided for converting the output from the adder 55 in logarithmic format into a linear format data. The log/lin conversion table 56 outputs, upon reception of the output from the adder 55 as an address signal, the addressed linear format data to be supplied to an averaging circuit 57. According to the present embodiment, a processing time period required for circuit operations such as an addition operation in the circuit section including the adder 52, table 54, adder 55, and table 56 is set at a time period equal to a time interval during which sixteen clock pulses $\phi$ are outputted (that is, a time period corresponding to sixteen time slots). Accordingly, it takes the time period corresponding to sixteen time slots for the input data ($W_{mt}$ or $W_{ct}$, and the output from the shift and gate circuit 53) of the adder 52 to be outputted from the log/lin conversion table 56 at each of the time slots TS(0) through (31). In other words, a delay time corresponding to sixteen time slots is incorporated to the circuit section 52 through 56. In the case that the circuit section 52 through 56 has a shorter delay time than that corresponding to sixteen time slots, the circuit section 52 through 56 is so arranged to have the correct delay time corresponding to sixteen time slots by inserting a suitable delay circuit with a certain delay time. The shift register 78 is provided for the purpose of delaying the data A(t)′ or I(t)′ by a time period equal to the processing time period required for the logarithmic sinusoid table 54. For example, if the processing at the adder 52 and table 54 takes a time period corresponding to six time slots, then the shift register 78 is made up of a six stage shift register so that the data A(t)′ or I(t)′ is delayed by a time period corresponding to six time slots. Thus, the timings are adjusted such that the data belonging to the same time slot can be inputted simultaneously to both input terminals of the adder 55. Alternatively, instead of using the shift register 78, the same effects can be attained by receiving the data A(t)1 or I(t)1 for the adder 49 from an appropriate stage of the shift register (FIG. 5) of the envelope data generator 4. Assuming that the shift register 78 with six stages was used, then the data A(t)1 or I(t)1 for the adder 49 should now be received from the sixth stage of the shift register 44.

The averaging circuit 57 is provided for suppressing a hunting phenomenon to be developed on a waveform of the output of the log/lin conversion table 56. In a processing block 58 made up of the aforementioned logarithmic sinusoid table 54, adder 55, and log/lin conversion table 56, the timings of operation, however, are not in precise synchronization with each other resulting in the hunting phenomenon which appears on the output of the log/lin conversion table 56 as shown in FIG. 11. Under observation of the hunting phenomenon, it can be understood that negative and positive spikes with substantially equal amplitudes are sequentially repeated and superposed on the waveform of an original data. In order to eliminate the hunting phenomenon, it has been found to be effective to provide the averaging circuit 57 which averages the present output of the log/lin conversion table 56 and the previous output prior to thirty-two time slots of the same table 56. The averaging circuit 57 comprises a thirty-two stage shift register 59 in which the output of the log/lin conversion table 56 is delayed by a time period of thirty-two clock pulses $\phi$ (thirty-two time slots), and an adder 60 which adds the outputs of the log/lin conversion table 56 and shift register 59. Since the output of the shift register 59 is the previous output of the log/lin conversion table 56 thirty-two time slots before, the output of the adder 60 at that time is the addition of the present and previous outputs of the log/lin conversion table 56. In order to devide the added output by two, the output of the adder 60 is derived from the second and following bits without using the least significant bit of the adder 60.

A shift register 62 is a sixteen stage shift register which receives the output of the adder 60 and delays it by one clock pulse or sixteen clock pulses $\phi$. The first stage output, counted from the input side of the shift register 62, is supplied to an input terminal I1 of a selector 63, while the sixteenth stage output is supplied to an input terminal I16 of the selector 63. The selector, 63 selectively outputs one of the data supplied to the input terminals I0, I1, and I16 in accordance with the parameter P7 supplied from the parameter generator 3. Specifically, the selector 63 selects one of the data supplied to the input terminals I0, I1, and I16 depending respectively upon the contents "0", "1", and "16" of the parameter P7, and outputs the selected one as a data SD to the shift and gate circuit 53. In the case where the data supplied to the input terminal I1 is selected by the selector 63, the Q terminal thereof develops a "1" signal to be supplied to a shift register 65 which is a thirty-one stage/one bit shift register delaying its output by a time period corresponding to thirty-one clock pulses $\phi$. The shift and gate circuit 53 comprises a shift circuit for shifting the data SD and a gate circuit for gating the output from the shift circuit, and operates in a manner shown in Table 2.

TABLE 2

| | OPERATION | | |
|---|---|---|---|
| $P_6$ | GATE CKT | SHIFT CKT | |
| 0 | CLOSE | — | |
| 1 | OPEN | X $\frac{1}{4}$ | |
| 2 | OPEN | X $\frac{1}{2}$ | |
| 3 | OPEN | X 1 | S |
| 4 | OPEN | X 2 | |
| 5 | OPEN | X 4 | |

In detail, at P6=0, the gate circuit is closed and therefore the data "0" is outputted. At P6=1, the gate circuit is opened wherein the data SD is shifted by two bits toward a lower bit, and therefore the data "$\frac{1}{4}$·SD" is outputted. Likewise, at P6=2, 3, . . . 5, the similar operation is performed in accordance with Table 2. For example, at P6=5, the shift circuit shifts the data SD by two bits toward a higher bit. Multiplication factors $\frac{1}{4}$, $\frac{1}{2}$, 1, 2, and 4 shown in Table 2represent values of S in the equation (1) described before.

An accumulator 66 (hereinafter abbreviated as ACC) accumulates the outputs from the adder 60 every time an accumulation signal H ("1" signal) is applied to a terminal AD of the ACC 66. The accumulated result is supplied to a register 67 and is cleared up when a clear signal CCR is applied to a terminal CL of the ACC 66. The register 67 stores the output from the ACC 66 when a load signal LD is applied thereto, and the output of the register 67 is supplied as the musical tone wave signal GD to the sound system 69 (FIG. 1). In FIG. 3, a reference numeral 71 represents an OR gate, reference numerals 72 through 74 represent AND gates, and reference numerals 75 through 77 represent inverters. In addition, signals TS0 through 3 to be supplied to the AND gate 72 are signals having a logical value "1" at the time slots TS(0) through (3), while signals TS0 through 15 to be supplied to the AND gate 73 are signals having a logical value "1" at the time slots TS(0) through (15).

Now, the operation of the musical tone forming circuit 2 thus constructed will be described, taking as one example of the operation a formation of the musical tone wave signal GD in accordance with the frequency modulation formula of the equation (1) above.

(1) Polyphonic Mode

Figure 12:
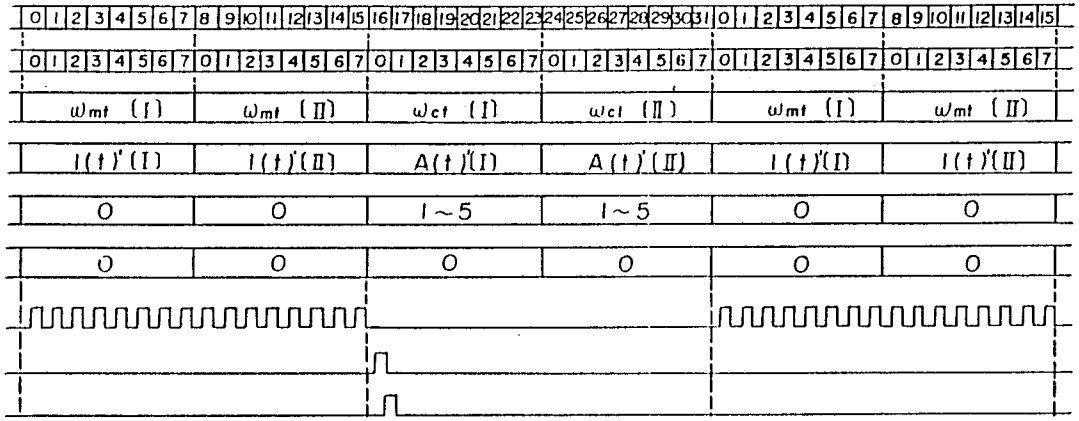

A timing chart illustrating the operation in the polyphonic mode is shown in FIG. 12, wherein reference characters (a) through (i) identifying a portion of the timing chart are representative of the following items:

(a) Time slots TS(0) through (31)
(b) Channel Timings
(c) Output of the Phase Angle Data Generator 1
(d) Output of the Envelope Data Generator 4
(e) Parameter P6 to be supplied from the Parameter Generator 3
(f) Parameter P7 to be supplied from the Parameter Generator 3
(g) Accumulation Signal H to be outputted from the AND gate 74
(h) Load Signal LD to be supplied to the Register 67
(i) Clear Signal CCR to be supplied to the ACC 66

Figure 13:
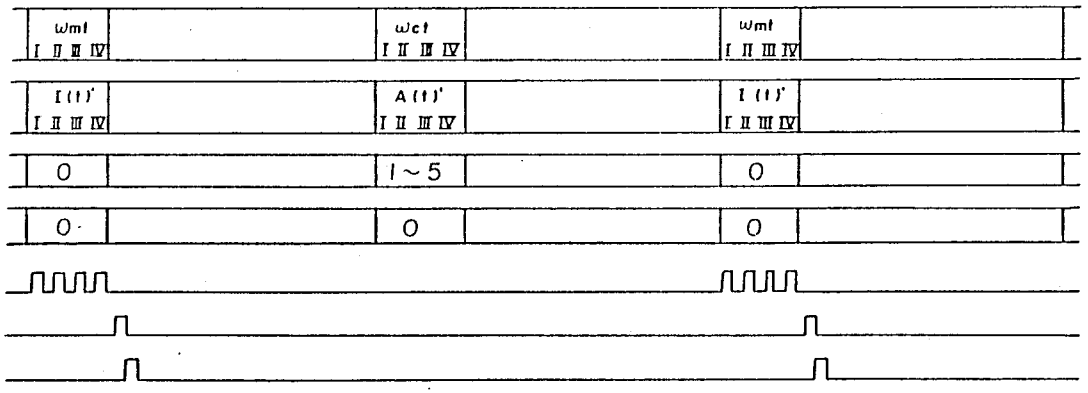

In FIGS. 12 and 13, reference letters I through IV indicate respectively the first through fourth series of musical tone signals.

First, at the time slot TS(0); a phase angle data $\omega_m t$ corresponding to a "0" channel of the first series of musical tone signals is derived from the phase angle data generator 1 to be supplied to the adder 52 which adds the phase angle data $\omega_m t$ and the output of the shift and gate circuit 53 to thereby deliver the added result to the logarithmic sinusoid table 54. In this case, with the parameter P6=0, the shift and gate circuit 53 outputs "0" (see Table 2) so that the adder 52 outputs the phase angle data $\omega_m t$ alone. Upon reception of the phase angle data $\omega_m t$, the logarithmic sinusoid table 54 reads therefrom a value log(sin $\omega_m t$) in order to supply it to the A input terminal of the adder 55. At this time instant, at the B input terminal of the adder 55, a modulation factor data I(t)' corresponding to the time slot TS(0) has been supplied from the envelope data generator 4 through the shift register 78. Therefore, the adder 55 outputs a value:

$$\log(\sin \omega_m t) + I(t)'$$

Substituting in the above value the following equation $$I(t)' = \log I(t),$$

then, the output value from the adder 55 is written as:

$$\log(\sin \omega_m t) + \log I(t) = \log\{I(t) \cdot \sin \omega_m t\}$$

The value $\log I(t) \cdot \sin \omega_m t$ is supplied to the log/lin conversion table 56, and a value of $$I(t) \cdot \sin \omega_m t$$

is read out of the table 56 to be supplide to the averaging circuit 57. It is to be noted that the time of reading operation of the value $I(t) \cdot \sin \omega_m t$ from the table 56 corresponds to the time slot TS(16) which is delayed by sixteen time slots from the time slots TS(0) due to the delay time existing in the circuit section 52 through 56 as described before. Thus, at the time slot TS(16), a value $I(t) \cdot \sin \omega_m t$ is outputted from the averaging circuit 57, with a variation portion resulted from the hunting phenomena being eliminated.

Since the parameter P7=0is used (see FIG. 12(*f*)) throughout the time slots TS(0) to (31) when the generation of musical tone signals GD is performed in compliance with the equation (1), the output value $I(t) \cdot \sin \omega_m t$ from the averaging circuit 57 is supplied to the shift and gate circuit 53 through the selector 63 at the time slot TS(16), without being given any significant time delay by the shift register 62. At this time instant, the shift and gate circuit 53 has been supplied with one of the values "1" through "5" as the parameter P6 (selection of the parameter P6 among the values "1" through "5" is determined by the tone color concerned at the time). Therefore, with the value $I(t) \cdot \sin \omega_m t$ from the averaging circuit 57 being supplied to the shift and gate circuit 53 through the selector 63, the shift and gate circuit 53 outputs at the time slot TS(16) a value $$S \cdot I(t) \cdot \sin \omega_m t$$

to be supplied to the A input terminal of the adder 52.

At the time of the time slot TS(16), the adder 52 is now provided with a phase angle data $\omega_c t$ corresponding to the "0" channel of the first series of musical tone signals at the B input terminal thereof. Then, the added value $$\omega_c t + S \cdot I(t) \cdot \sin \omega_m t$$

is outputted from the adder 52 and is supplied to the logarithmic sinusoid table 54. As a result, a value $$\log\{\sin(\omega_c t + S \cdot I(t) \cdot \sin \omega_m t)\}$$

is read out of the table 54 and is supplied to the A input terminal of the adder 55. At this time instant, the adder 55 is now provided at its B input terminal with an amplitude data A(t)' corresponding to the time slot TS(16) from the envelope data generator 4 through the shift register 78. Therefore, the adder 55 outputs a value:

$$A(t)' + \log\{\sin(\omega_c t + S \cdot I(t) \cdot \sin \omega_m t)\}$$

Substituting in the above value the following equation $$A(t)' = \log A(t),$$

then, the output from the adder 55 is written as:

$$\log\{A(t) \sin(\omega_m t + S \cdot I(t) \sin \omega_m t)\}$$

The above value is supplied to the log/lin conversion table 56, and a value of $$A(t) \sin(\omega_c t + S \cdot I(t) \sin \omega_m t)$$

is outputted at the time slot TS(0) from the averaging circuit 57.

In addition to the above description, since the signal M/P is kept "0" in the polyphonic mode, a "1" signal is being supplied to a first input terminal of the AND gate 73 through the inverter 75. The AND gate 72 is kept disabled in the polyphonic mode due to the provision of "0" signal at its first input terminal. The parameter P7 is always kept at "0" during formation of musical tone signals in compliance with the above equation (1) to thereby deliver a "0" signal from the Q terminal of the selector 63. Thus, every stage of the shift register 65 is at "0" state so that "1" signals are being outputted from the inverter 77 to thereby keep the AND gate 74 enabled. With the above circuit conditions, when the signals TS0 through 15, that is, "1" signals are supplied sequentially to a third input terminal of the AND gate 73, inversed clock pulses $\phi$ are accordingly supplied as the accumulation signal H to the AD terminal of the ACC 66 through the AND gate 73, OR gate 71, and AND gate 74, at every time slot TS(0) through (15) (refer to FIG. 12(*g*)).

Upon reception of the accumulation signal H, the ACC 66 accumulates at the time slot TS(0) the value $$A(t)\sin(\omega_c t + S \cdot I(t) \sin \omega_m t)$$

outputted from the averaging circuit 57.

At the same time slot TS(0), it is apparent that another phase angle data $\omega_m t$ for use in the next waveform calculation is supplied to the B input terminal of the adder 52.

The above processes are related to the formation of musical tone signals corresponding to the channel-0 of the first series of musical tone signals. The similar processes are performed at the time slots TS(8) and (24) in order to form musical tone signals corresponding to the channel-0 of the second series of musical tone signals. By combining the musical tone signals of the first and second series, the ACC 66 obtains a musical tone wave signal corresponding to the assigned key for the channel-0.

The musical tone signals corresponding to the first through seventh channels are formed in the same manner as described heretofore. At the time instant when the musical tone signal of the seventh channel of the sound series of musical tone signals is accumulated in the ACC 66, all the musical tone signals throughout the 0 to 7th channel of both first and second series of musical tone signals has been accumulated in the ACC 66. The accumulated value of all the musical tone signals is then loaded to the register 67 at the time slot TS(16) when the load signal LD (FIG. 12(*h*)) is supplied to the register 67, the accumulated value being supplied as the musical tone wave signal to the sound system 69 shown in FIG. 1. Thereafter, the ACC 66 is cleared at the time slot TS(17) upon reception of the clear signal CCR (FIG. 12( *i*)), the new operation for forming musical tone signals having been started again at the time slot TS(0). The musical tone wave signals GD supplied to the sound system 69 are converted into an analog signal to thereby produce a musical tone.

(2) Monophonic Mode

A timing chart illustrating the operation in the monophonic mode is shown in FIG. 13, wherein reference characters (a) through (g) correspond respectively to (c) through (i) of FIG. 12. The time slots TS(4) through (15) and (20) through (31) are not used here in the monophonic mode.

In the monophonic mode, a musical tone signal of the first series is formed in combination at the time slots TS(0) and (16), which musical tone signal is supplied to the ACC 66 at the next time slot TS(0). Likewise, musical tone signals of the second, third, and fourth series are formed respectively at the time slots TS(1) and (17), TS(2) and (18), and TS(3) and (19), which musical tone signals are supplied to the ACC 66 respectively at the time slots TS(1) through (3). The formation of musical tone signals of each of the first through fourth series is performed in a similar manner as in the processes of the formation of musical tone signals of the first (or second) series in the polyphonic mode described above.

In the monophonic mode, the signal M/P is at "1" state, and therefore the AND gate 73 is kept disabled, while the AND gate 72 is supplied at the first input terminal thereof "1" signal. As a result, when the signals TS0 through TS3 ("1" signals) are supplied to the third input terminal of the AND gate 72 so as to enable it, inversed clock pulses $\phi$ are accordingly supplied at every time slot TS(0) through (3) (refer to FIG. 13(*e*)) to the AD terminal of the ACC 66 as the accumulation signals H through the AND gate 72, OR gate 71, and AND gate 74. Therefore, the musical tone signals of the first through fourth series are respectively accumulated in the ACC 66 upon reception of the accumulation signal H at every time slot TS(0) through (3). The accumulated value is then loaded to the register 67 at the time slot TS(4) when the load signal LD is supplied thereto. Thereafter, at the time slot TS(5), upon reception of the clear signal CCR at the terminal CL of the ACC 66, the ACC 66 is cleared up at the rising edge of the clear signal CCR. The accumulated value stored in the register 67 is supplied as the musical tone wave signal GD to the sound system 69 where the signal GD is converted into an analog signal to be produced as a musical tone.

Figure 14:
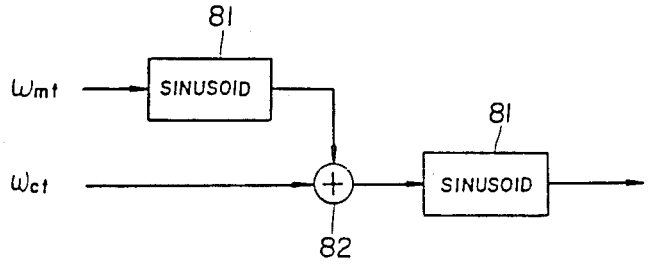
Figure 15:
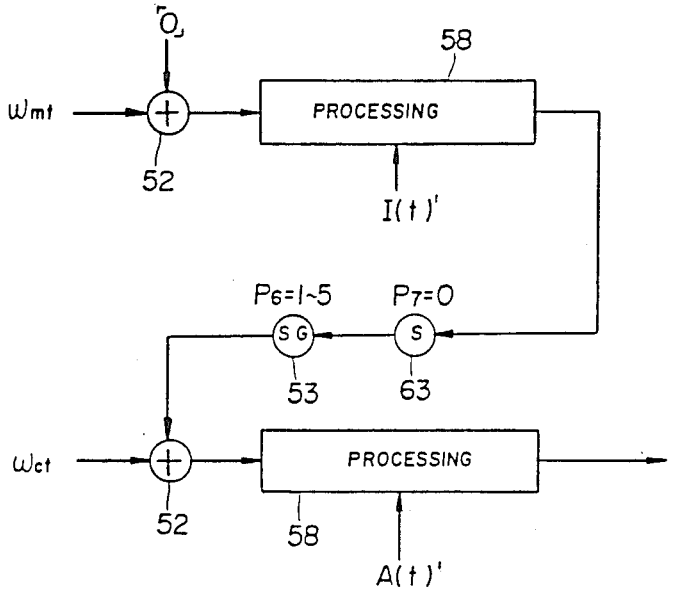

The operation of the musical tone forming circuit 2 has been described with respect to the formation of musical tone wave signals GD in compliance with the equation (1) in both polyphonic and monophonic modes. A basic operational illustration of the above operation is shown in FIG. 14 wherein a reference numeral 81 denotes a sinusoid table outputting a linear data, and a reference numeral 82 denotes an adder. FIG. 15 is a more concrete operational illustration of the musical tone forming circuit 2, the reference numbers used in FIG. 15 representing similar or identical elements having the same reference numbers in FIG. 3. In FIGS. 14 and 15, the operational illustration explains the processes of one of the plural series of musical tone signals.

Various frequency modulation formulas can be used in the formation of musical tone wave signals GD, and the operations thereof will be described in brief.

Figure 16:
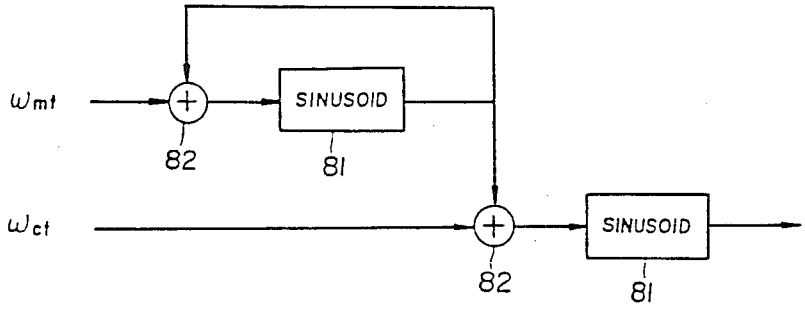
Figure 19:
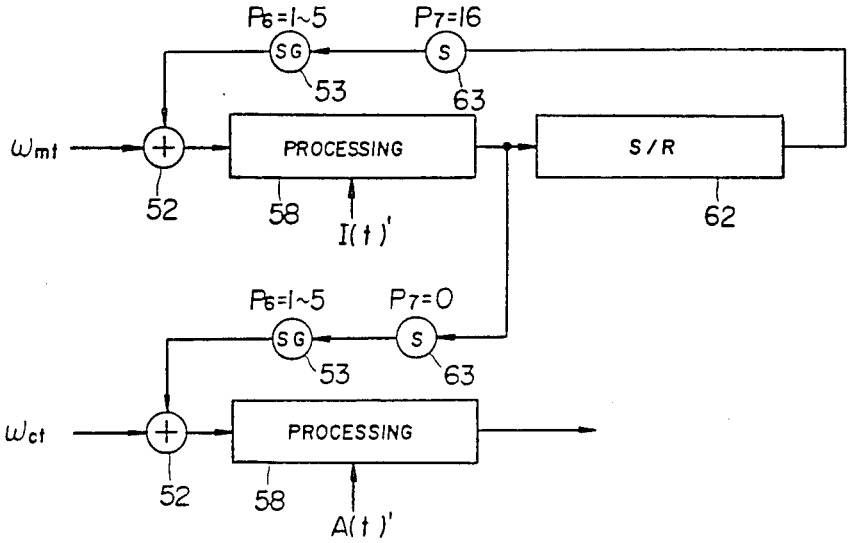

FIG. 16 is a basic operational illustration using a second frequency modulation formula other than the above equation (1). In carrying out the operation shown in FIG. 16, the parameters P6 and P7, as of respectively shown in FIG. 17(*e*) and (*f*) for the polyphonic mode and in FIG. 18(*c*) and (*d*) for the monophonic mode, are supplied at the timings shown in respective FIGS. to the selector 63 and shift and gate circuit 53 shown in FIG. 3. A more concrete operational illustration for this is given in FIG. 19.

Figure 20:
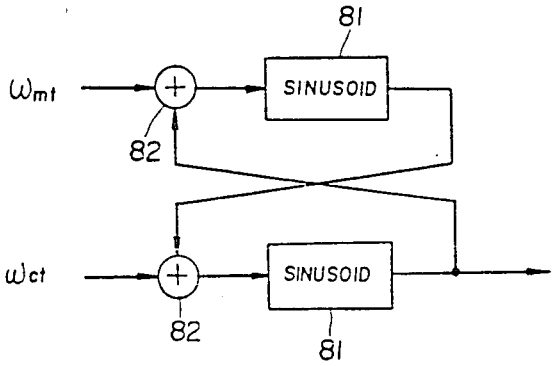
Figure 23:
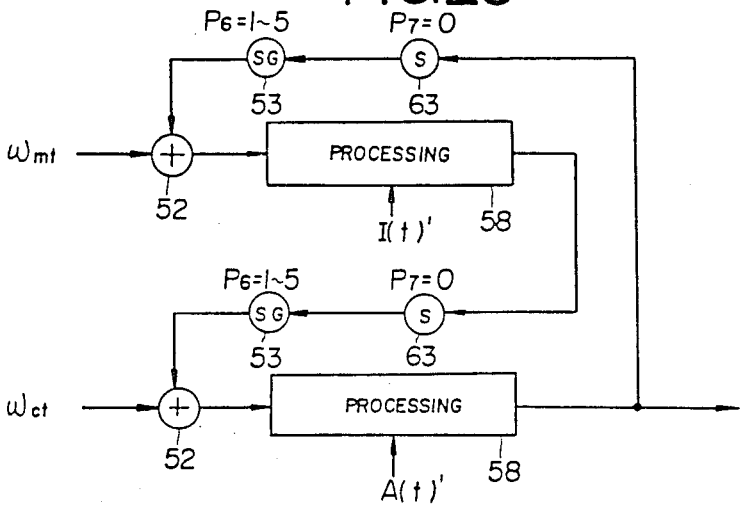

FIG. 20 is a basic operational illustration using a third frequency modulation formula. In carrying out this operation, the parameters P6 and P7, as of respectively shown in FIG. 21(*e*) and (*f*) for the polyphonic mode and in FIG. 22(*c*) and (*d*) for the monophonic mode, are supplied at the timings shown in respective FIGS. to the selector 63 and shift and gate circuit 53 shown in FIG. 3. A more concrete operational illustration for this is given in FIG. 23.

Figure 17:
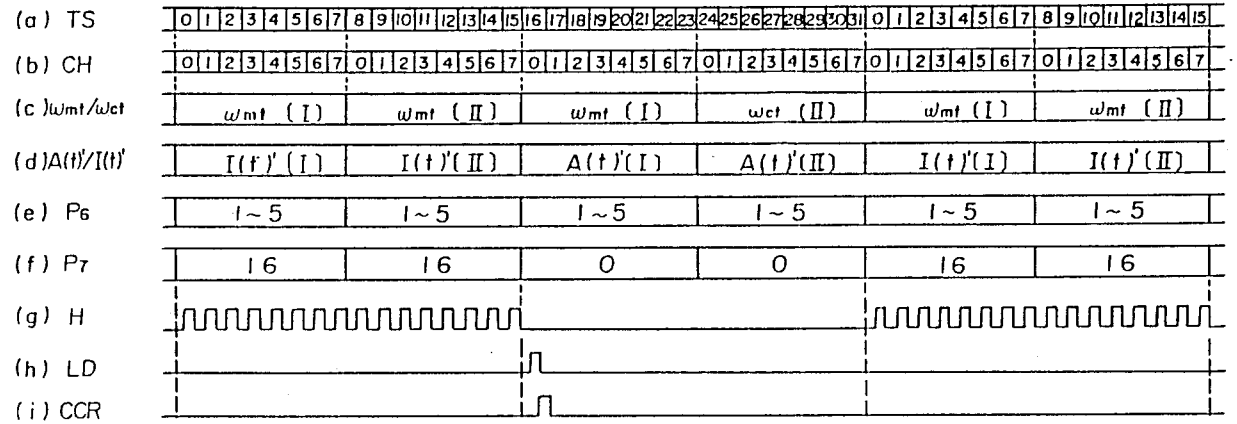
Figure 18:
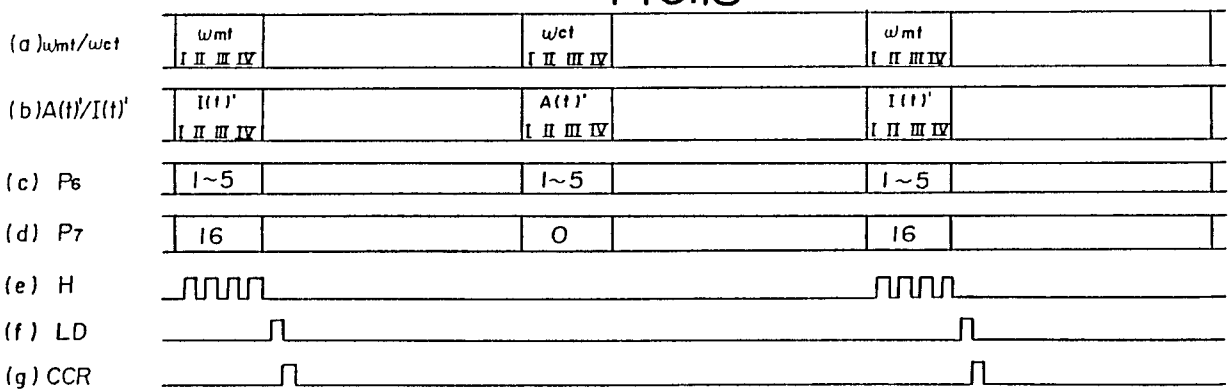
Figure 21:
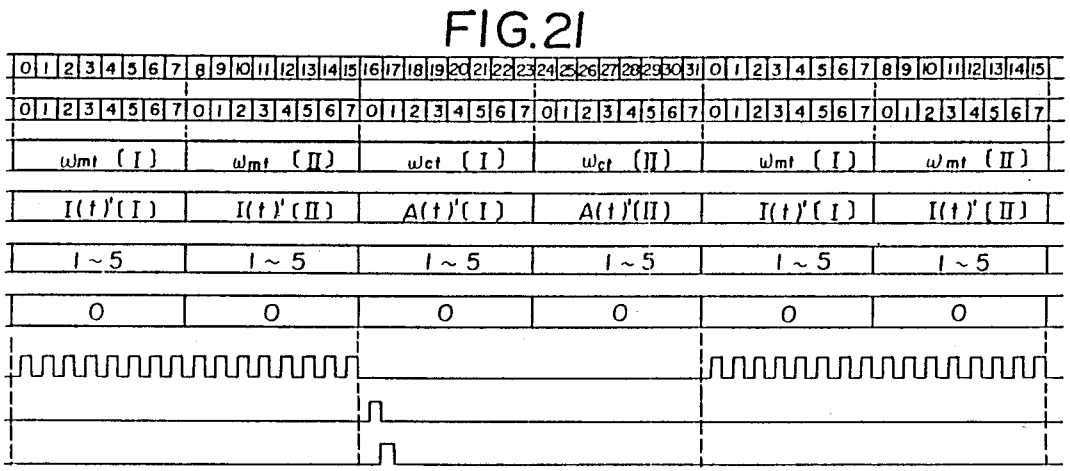
Figure 22:
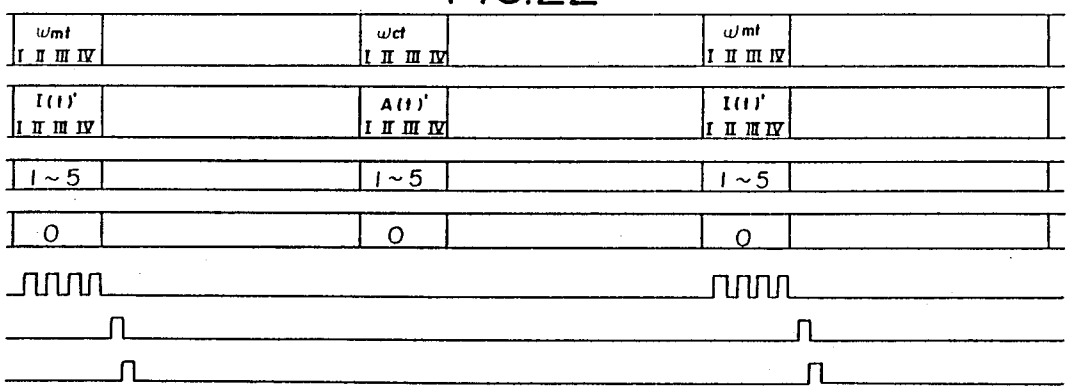

FIG. 17(*a*) through (*i*) and FIG. 21(*a*) through (*i*) respectively correspond to FIG. 12(*a*) through (*i*), and FIG. 18(*a*) through (*g*) and FIG. 22(*a*) through (*g*) respectively correspond to FIG. 13(*a*) through (*g*). With reference to these FIGS., it will be apparent to those skilled in the art that it is only necessary to change the parameters P6 and P7 in order to realize the basic operations of FIGS. 16 and 20.

As seen from the foregoing description, the musical tone forming circuit 2 shown in FIG. 3 can be utilized for various frequency modulation formulas in the formation of musical tone signals by changing only the parameters P6 and P7. In the formation described heretofore, a single frame (time slots TS(0) through (31)) has been used as a basic unit of musical tone signal formation, and the number of time slots TS incorporated in one series of musical tone signals has been "two". However, according to another embodiment, it may also be possible to form musical tone signals by using two frames as a basic unit and "four" time slots TS for one series of musical tone signals. By doing so, musical tone wave signals GD rich in tone color can be formed.

Figure 24:
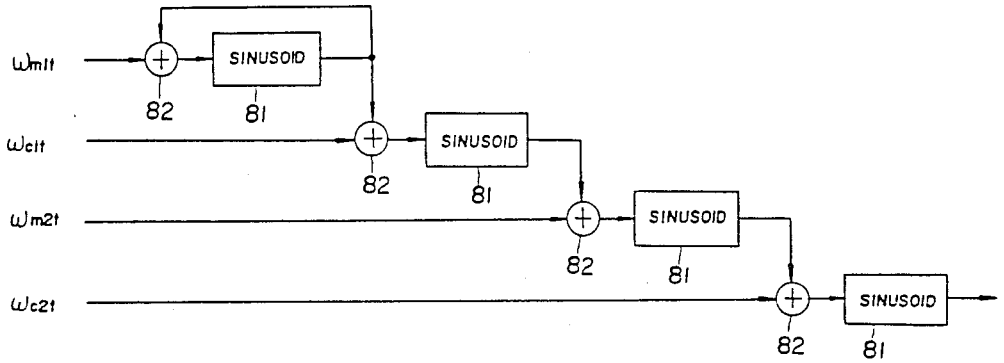

FIG. 24 is a basic operational illustration for use in such an embodiment. In carrying out this operation, the phase angle data $\omega_m t$ and $\omega_c t$, amplitude data A(t), modulation factor data I(t), parameters P6, P7, and other control signals are required to be supplied at the respective timings shown in FIG. 25 to respective circuit elements shown in FIG. 3. A more concrete operational illustration for this is given in FIG. 26.

Figure 25:
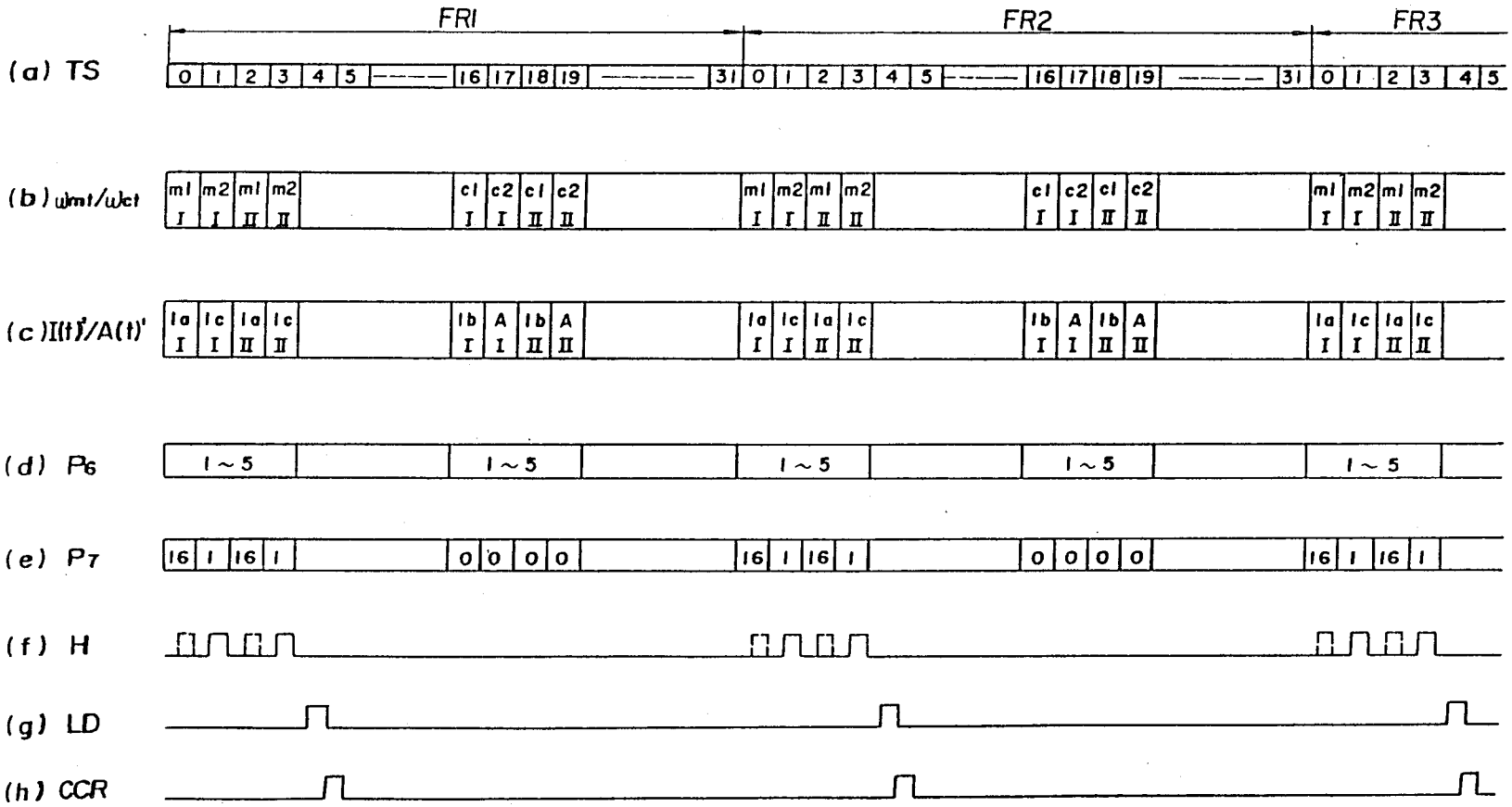
Figure 26:
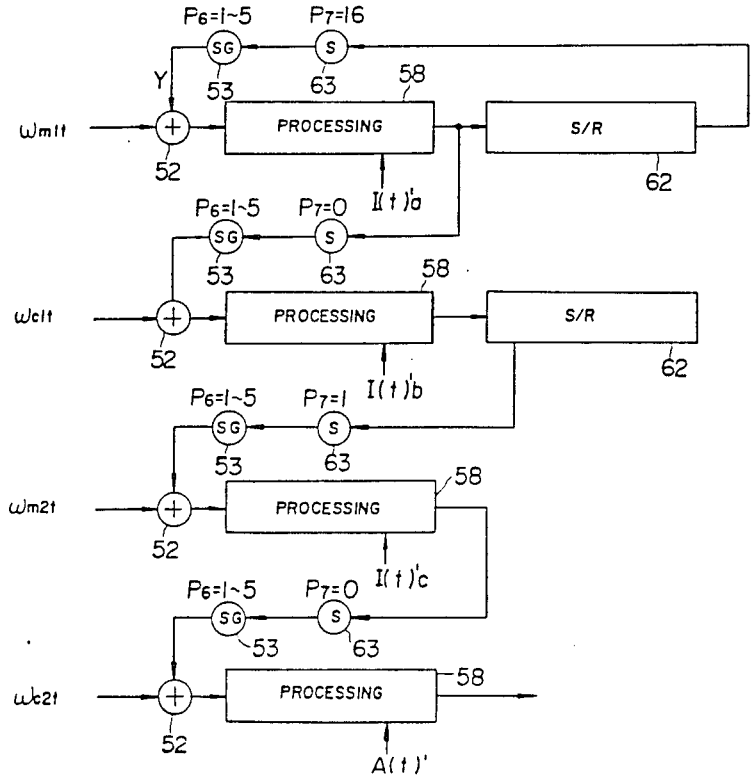

The reference characters M1 and M2 in FIG. 25 mean the phase angle data $\omega_{m1}t$ and $\omega_{m2}t$ in FIG. 26, respectively; C1 and C2 are for the phase angle data $\omega_{c1}t$ and $\omega_{c2}t$ in FIG. 26; Ia through Ic are for the modulation factor data I(t)'a through I(t)'c in FIG. 26; and A is for the amplitude data A(t) in FIG. 26.

The musical tone signal formation by using two frames as a basic unit can not be employed for the polyphonic mode, but for the monophonic mode only.

The operation of the musical tone forming circuit 2 with which the operation for FIG. 24 is carried out will be described with reference to FIGS. 25 and 26.

At the time slot TS(0) of the first frame FR1 shown in FIG. 25(*a*), upon reception of the phase angle data $\omega_{m1}t$ (FIG. 25(*b*)) at the B input terminal of the adder 52, the adder 52 outputs a value to be supplied to the processing block 58:

$$\omega_{m1}t+Y$$

wherein Y represents the output of the shift and gate circuit 53. At the same time slot TS(0), the modulation factor data I(t)'a has been supplied to the processing block 58 from the envelope data generator 4 (FIG. 25(*c*)). Therefore, at the time slot TS(16) of the first frame FR1, the processing block 58 outputs a value:

$$I(t)_a \sin(\omega_{m1}t+Y)$$

Since the parameters P7=0 and P6=1 through 5 are supplied at the time slot TS(16) to the selector 63 and shift and gate circuit 53 (FIG. 25(*d*) and (*e*)), the value outputted from the processing block 58 and supplied to the shift and gate circuit 53 through the selection 63 is multiplied by S and therefore:

$$S\cdot I(t)_a \sin(\omega_{m1}t+Y)$$

This value is supplied to the A input terminal of the adder 52 the B input terminal of which is provided with the phase angle data $\omega_{c1}t$ at the time slot TS(16). Therefore, the adder 52 outputs a value to be supplied to the processing block 58:

$$\omega_{c1}t+S\cdot I(t)_a \sin(\omega_{m1}t+Y)$$

Since the modulation factor data $I(t)_b$ for the time slot, TS(16) has been supplied to the processing block 58, the processing block 58 outputs a value:

$$I(t)_b \sin\{\omega_{c1}t+S\cdot I(t)_a \sin(\omega_{m1}t+Y)\}$$

This value is loaded to the shift register 62 which in turn supplies the value to the input terminal I1 of the selector 63 at the next time slot, that is, at the time slot TS(1) of the second frame FR2. At this time slot TS(1), the parameter P7=1 is supplied to the selector 63, and the parameters P6=1 through 5 to the shift and gate circuit 53. Accordingly, the value supplied to the input terminal I1 of the selector 63 is transferred to the shift and gate circuit 53 wherein the value is multiplied by S to obtain a new value:

$$S\cdot I(t)_b \sin\{\omega_{m1}t+S\cdot I(t)_a \sin(\omega_{m1}t+Y)\}=X \quad (2)$$

This value is supplied to the A input terminal of the adder 52 the B input of which is provided with the phase angle data $\omega_{m2}t$. Therefore, the processing block 58 is provided with a value:

$$\omega_{m2}t+X$$

Since the modulation factor data I(t)'c for the time slot TS(1) of the second frame FR2 has been supplied to the processing block 58, the processing block 58 outputs at the time slot TS(17) of the second frame FR2 a value:

$$I(t)_c \sin(\omega_{m2}t+X)$$

This value is supplied to the A input terminal of the adder 52 the B input terminal of which is provided with the phase angle data $\omega_{c2}t$ at the time slot TS(17) of the second frame FR2. Therefore, the processing block 58 is provided with a value:

$$\omega_{c2}t+S\cdot I(t)_c \sin(\omega_{m2}t+X)$$

Since the amplitude factor A(t)' for the time slot TS(17) of the second frame FR2 has been supplied to the processing block 58, the block 58 outputs at the time slot TS(1) of the third frame FR3 a value:

$$A(t)\sin\{\omega_{c2}t+S\cdot I(t)_c \sin(\omega_{m2}t+X)\}$$

At the same time slot TS(1), this value is accumulated in the ACC 66 upon reception of the accumulation signal H from the AND gate 74 (FIG. 25(*t*)).

The computational processes of the musical tone signal formation has been described with respect to the first series of musical tone signals. The similar processes as above are performed for the second series of musical tone signals, that is, at the time slots TS(2) and (18) of the first frame FR1, and at the time slots TS(3) and (19) of the second frame FR2. The computational result is then accumulated in the ACC 66 at the time slot TS(3) of the third frame FR3. The accumulated value of the musical tone signals of both first and second series is loaded to the register 67 at the timing of the load signal LD (FIG. 25(g)) which is delivered at the time slot TS(4) of the third frame FR3. The ACC 66 is thereafter cleared at the time slot TS(5) of the third frame FR3 upon reception of the clear signal CCR. The accumulated value stored in the register 67 is supplied as the musical tone wave signal GD to the sound system 69 in order to be produced as a musical tone.

As described above, in the musical tone formation using two frames as a basic unit, a musical tone signal for one series of musical tone signals is formed in compliance with the following frequency modulation formulas:

$$E(t)=A(t)\sin\{\omega_{c2}t+S\cdot I(t)c\ \sin(\omega_{m2}t+X)\}$$

$$X=S\cdot I(t)b\ \sin\{\omega_{c1}t+S\cdot I(t)a\ \sin(\omega_{m1}t\ 30\ Y)\}$$

wherein Y represents the output of the processing block 58 at the time slot TS prior to sixteen time slots TS. This can be readily understood from the value "16" of the parameter P7 at the time slots TS(0) and (2). Thus, Y may be written in the form of:

$$Y = I(t)a\ \sin(\omega_{m1}t + Y_1)$$

$$Y_1 = I(t)a\ \sin(\omega_{m1}t + Y_2)$$

$$Y_2 = I(t)a\ \sin(\omega_{m1}t + Y_3)$$

$$\vdots$$

In the monophonic mode, as described previously, a pulse signal is outputted from the OR gate 71 at every time slots TS(0) through (3). Thus, the outputs of the OR gate 71 include pulse signals depicted in a broken line as well as in a solid line as shown in FIG. 25(f). However, in the computational processes of the musical tone signal formation by using two frames as a basic unit, the outputs from the averaging circuit 57 at the timings of the pulse signals depicted in a broken line are an intermediate data in the course of computation, and are of the kind that the accumulation thereof into the ACC 66 should be prohibited. There arises a need for eliminating those pulse signals depicted in a broken line from the circuitries. To this end, the shift register 65, inverter 77, and AND gate 74 have been provided as shown in FIG. 3.

More in particular, for example at the time slot TS(1) of the first frame FR1, the parameter P7=1 is supplied to the selector 63 causing it to output at the same time slot TS(1) a "1" signal from its terminal Q. The "1" signal is supplied to the shift register 65, and after the lapse of thirty-one clock pulses $\phi$, that is, at the time slot TS(0) of the second frame FR2, the "1" signal is outputted therefrom. As a result, the output of the inverter 77, now "0" signal, causes the AND gate 74 to be disabled so that the pulse signal depicted in a broken line is eliminated at the time slot TS(0) of the second frame FR2 (FIG. 25(5)). Likewise, since a "1" signal appears at the Q terminal of the selector 63 at the time slot TS(3) of the first frame FR1, the broken line pulse signal at the time slot TS(2) of the second frame FR2 is also eliminated.

Although the invention has been described in its preferred form with a certain degree of particularity, it is understood that various changes and modification may be made in the invention without departing from the spirit and scope thereof. One obvious modification is that, although a musical tone signal corresponding to one key has been formed in the electronic organ shown in FIGS. 1 through 5 by using two series of musical tone signals in the case of the polyphonic mode and four series of musical tone signals in the case of the monophonic mode (excluding the case where the two-frame basic unit is employed), the number of series of musical tone signals may be increased by two times, three times and so forth in order to form musical tone signals more rich in tone color. A single series of musical tone signals may also be employed if desired.

Furthermore, although the frequency modulation formula has been used in the above embodiments in order to form musical tone signals, the invention is not limited to the specific frequency modulation formula, but the invention may also be applied to various other computational formulas.

What is claimed is:

1. An electronic musical instrument comprising:

time channel providing means for providing repeated cycles of a plurality of correspondingly located time slots, each said corrspondingly located time slot over repeated cycles constituting a time-division-multiplexed time channel;

tone pitch information generating means for generating a pitch information signal in synchronism with each said time channel, each said pitch information signal designating a pitch of a musical tone signal to be formed during each said time channel;

parameter generating means for generating parameter signals for computing each said musical tone signal in synchronism with each said time channel, based on a modulation formula;

tone forming means for forming each said musical tone signal by repeatedly executing a signal forming computation based on said modulation formula, using said pitch information signal and said parameter signals; and time slot assigning means for variably assigning a plural number of said cycles of said time slots, in each said time channel, to each said signal forming computation to allow execution thereof during said plural cycles, a number of said plural cycles being determined by a kind of said modulation formula.

2. An electronic musical instrument according to claim 1, wherein said tone forming means executes each said signal forming computation as a plurality of sub-computations, said time assigning means respectively assigning each of said plural cycles to each of said plurality of sub-computations, wherein some of said plurality of sub-computations use a result of a sub-computation executed precedingly thereto as an argument in said sub-computation.

3. An electronic musical instrument according to claim 2, wherein one of said modulation formulas is expressed by $$A(t)\cdot\sin(w_c t + S\cdot I(t)\cdot\sin w_m t)$$

wherein A(t), S and I(t) correspond respectively to said parameter signals, and $w_c t$ and $w_m t$ correspond to said pitch information signal, said plurality of sub-computations including a first sub-computation and a second sub-computation, said first sub-computation being expressed by $S\cdot I(t)\cdot\sin w_m t$ and executed in a first one of said plural cycles, said second sub-computation being expressed by said modulation formula and executed in a second one of said plural cycles.

4. An electronic musical instrument comprising:

time channel providing means for providing a plurality of time-division-multiplexed time channels, by producing repeated cycles of a plurality of correspondingly located time slots, each said correspondingly located time slot over the repeated cycles constituting each time channel;

monophonic/polyphonic designating means for selectively designating one of: (a) a monophonic mode or (b) a polyphonic mode, in which said electronic musical instrument operates;

tone pitch information signal generating means for generating tone pitch information signals which desginate pitches of musical tones to be simultaneously generated, respectively;

pitch information assigning means for assigning only a selected one of said tone pitch information signals to one of said plurality of time channels when said monophonic mode is designated, and for assigning a predetermined number of said tone pitch information signals respectively to said plurality of time channels when said polyphonic mode is designated; and time-division multiplex tone forming means for forming tones for both said monophonic mode and for said polyphonic mode, said tone forming means forming a musical tone signal by repeatedly executing a signal forming computation based on a modulation formula in response to each tone pitch information signal assigned to each said time channel, wherein at least two cycles of said time slots in each said time channel are used to execute each said signal forming computation.

5. An electronic musical instrument comprising:

time channel providing means for providing a plurality of time-divison-multiplexed time channels, by producing repeated cycles of a plurality of correspondingly located time slots, each said correspondingly located time slot over the repeated cycles constituting each time channel;

monophonic/polyphonic designating means for selectively designating one of: (a) a monophonic mode or (b) a polyphonic mode, in which said electronic musical instrument operates;

tone pitch information signal generating means for generating tone pitch information signals which designate pitches of musical tones to be simultaneously generated, respectively;

pitch information assigning means for assigning a selected one of said tone pitch information signals to one of said plurality of time channels when said monophonic mode is designated, and for assigning a predetermined number of said tone pitch information signals respectively to said plurality of time channels when said polyphonic mode is designated; and tone forming means for forming a musical tone signal by repeatedly executing a signal forming computation based on a modulation formula in response to each tone pitch information signal assigned to each said time channel, wherein at least two cycles of said time slots in each said time channel are used to execute each said signal forming computation, and wherein each said signal forming computation comprises at least two sub-computations which are executed respectively in said at least two cycles, a second of said at least two sub-computations using a result of a sub-computation executed precedingly thereto as an argument in said sub-computations.

6. An electronic musical instrument according to claim 5 further comprising parameter generating means for generating parameter signals in synchronism with said time channel, said parameter signals indicative of parameters necessary for computing each said musical tone signal based on said modulation formula, wherein said modulation formula is expressed by $$A(t)\cdot\sin(w_c t + S\cdot I(t)\cdot\sin w_m t)$$

wherein A(t), S and I(t) correspond respectively to said parameters, and $w_c t$ and $w_m t$ correspond to said tone pitch information signal, said at least two sub-computations including a first sub-computation and a second subcomputation, said first sub-computation being expressed by $S\cdot I(t)\cdot\sin w_m t$ and executed in a first one of said at least two cycles, said second sub-computation being expressed by said modulation formula and executed in a second one of said at least two cycles.

* * * * *